US009620867B2

(12) United States Patent
Hamabe

(10) Patent No.: US 9,620,867 B2
(45) Date of Patent: Apr. 11, 2017

(54) ANTENNA APPARATUS INCLUDING TWO PAIRS OF ANTENNAS PROVIDED RESPECTIVELY TO BE SYMMETRIC WITH RESPECT TO SYMMETRIC LINE

(71) Applicant: Panasonic Corporation, Osaka (JP)

(72) Inventor: Taichi Hamabe, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 484 days.

(21) Appl. No.: 13/955,510

(22) Filed: Jul. 31, 2013

(65) Prior Publication Data

US 2013/0314297 A1 Nov. 28, 2013

Related U.S. Application Data

(63) Continuation of application No. PCT/JP2013/000401, filed on Jan. 25, 2013.

(30) Foreign Application Priority Data

Jan. 31, 2012 (JP) ..... 2012-017703
Jan. 31, 2012 (JP) ..... 2012-017704
Feb. 10, 2012 (JP) ..... 2012-027266

(51) Int. Cl.
*H01Q 21/00* (2006.01)
*H01Q 21/28* (2006.01)
(Continued)

(52) U.S. Cl.
CPC ..... *H01Q 21/28* (2013.01); *H01Q 1/243* (2013.01); *H01Q 1/521* (2013.01); *H01Q 9/42* (2013.01)

(58) Field of Classification Search
CPC ..... H01Q 21/28; H01Q 1/243; H01Q 1/521; H01Q 9/42
(Continued)

(56) References Cited

U.S. PATENT DOCUMENTS 6,686,886 B2 2/2004 Flint et al.
2004/0257283 A1 12/2004 Asano et al.
(Continued)

FOREIGN PATENT DOCUMENTS

JP 2003-101334 4/2003
JP 3618621 2/2005
(Continued)

OTHER PUBLICATIONS

International Search Report issued Apr. 23, 2013 in International (PCT) Application No. PCT/JP2013/000401.
(Continued)

*Primary Examiner* — Graham Smith
(74) *Attorney, Agent, or Firm* — Wenderoth, Lind & Ponack, L.L.P.

(57) ABSTRACT

An antenna apparatus is configured to include first, second, third and fourth antennas. The first and fourth antennas are provided to be symmetrical with respect to a predetermined symmetry line on the grounding conductor, and the second and third antennas are arranged to be symmetrical with respect to the symmetry line so that the second and third feeding points are separated apart by a predetermined distance. A first antenna element of the first antenna and a fourth antenna element of the fourth antenna are formed to be substantially parallel to a Y-axis direction, and a second antenna element of the second antenna and a third antenna element of the third antenna are formed to be substantially parallel to an X-axis direction.

19 Claims, 22 Drawing Sheets

(51) Int. Cl.

| | |
|---|---|
| ***H01Q 1/24*** | (2006.01) |
| ***H01Q 1/52*** | (2006.01) |
| ***H01Q 9/42*** | (2006.01) |

(58) Field of Classification Search
USPC ..... 343/893
See application file for complete search history.

(56) References Cited

U.S. PATENT DOCUMENTS

| | | | |
|---|---|---|---|
| 2005/0266903 | A1 | 12/2005 | Masaki |
| 2005/0285804 | A1 | 12/2005 | Usui et al. |
| 2006/0061512 | A1 | 3/2006 | Asano et al. |
| 2007/0139270 | A1 | 6/2007 | Takei et al. |
| 2011/0068983 | A1 | 3/2011 | Koide et al. |

FOREIGN PATENT DOCUMENTS

| | | |
|---|---|---|
| JP | 2005-341265 | 12/2005 |
| JP | 2006-13797 | 1/2006 |
| JP | 2006-94521 | 4/2006 |
| JP | 2006-527941 | 12/2006 |
| JP | 2007-281906 | 10/2007 |
| JP | 2008-141661 | 6/2008 |
| JP | 2010-130115 | 6/2010 |
| JP | 2011-66767 | 3/2011 |
| JP | 2011-151658 | 8/2011 |
| WO | 2005/048404 | 5/2005 |

OTHER PUBLICATIONS

International Preliminary Report on Patentability and Written Opinion of the International Searching Authority issued Aug. 14, 2014 in International (PCT) Application No. PCT/JP2013/000401.

ANTENNA APPARATUS INCLUDING TWO PAIRS OF ANTENNAS PROVIDED RESPECTIVELY TO BE SYMMETRIC WITH RESPECT TO SYMMETRIC LINE

CROSS-REFERENCE TO RELATED APPLICATIONS

This is a continuation application based on PCT application No. PCT/JP2013/000401 as filed on Jan. 25, 2013, which claims priority to (1) Japanese patent application No. JP 2012-017703 as filed on Jan. 31, 2012, (2) Japanese patent application No. JP 2012-017704 as filed on Jan. 31, 2012, and (3) Japanese patent application No. JP 2012-027266 as filed on Feb. 10, 2012, the contents of which are incorporated herein by reference.

TECHNICAL FIELD

The present disclosure relates to an antenna apparatus, a wireless communication apparatus including the antenna apparatus, and an electronic device including the wireless communication apparatus.

RELATED ART

Portable type electronic devices each having a wireless communication apparatus to receive broadcasting signals of terrestrial digital television broadcasting and the like, and a display apparatus to display the received broadcasting signals has been popularized. Such electronic devices use adaptive control of a combining diversity system or the like to combine in phase received signals received by a plurality of antenna elements as a method for achieving highly sensitive receiving. Moreover, a plurality of antennas need to be provided inside or outside the casing of the electronic device in order to perform adaptive control, and various methods are proposed concerning the configuration and arranging method of the plurality of antennas (See, for example, Patent Document 1).

Patent Documents related to this disclosure are as follows:

Patent Document 1: Japanese patent laid-open publication No. JP 2007-281906 A;

Patent Document 2: Japanese patent publication No. JP 3618621 B2;

Patent Document 3: Japanese patent laid-open publication No. JP 2011-151658 A; and Patent Document 4: U.S. Pat. No. 6,686,886.

Generally speaking, in the electronic devices for use in a television broadcasting receiver apparatus or the like, the desired fractional bandwidth is about 40%, and an antenna apparatus having very wide band is required. However, in such electronic devices, the antenna cannot help being arranged in the vicinity of the grounding conductor of a circuit board or a conductor of a shield plate or the like in the electronic devices as the electronic devices are reduced in size. In this case, the gain of each antenna sometimes decreases. Moreover, in such electronic devices, the receiver sensitivity should be beneficially higher in various directions. However, when a plurality of antennas that use radio waves in an identical frequency band are used in order to improve the gain of the antenna apparatus of the electronic devices in various directions, signal mixing from other antennas occurs in each antenna attributed to electromagnetical coupling between the antennas, and the signal-to-noise ratio at the time of receiving by using the antennas is lowered, sometimes substantially decreasing the gain.

SUMMARY OF THE DISCLOSURE

An object of the present disclosure is to solve the aforementioned problems, and provide an antenna apparatus including a plurality of antennas and being able to prevent the decrease in the gain, a wireless communication apparatus including the antenna apparatus, and an electronic device including the wireless communication apparatus.

According to the present disclosure, there is provided an antenna apparatus configured to include first, second, third and fourth antennas. The first antenna is configured to include a first radiating antenna element, that is formed to be substantially parallel to a predetermined first direction, and is fed with electric power from a first feeding point provided at a first edge portion of a grounding conductor. The second antenna is configured to include a second radiating antenna element, that is formed to be substantially parallel to a predetermined second direction different from the first direction, and is fed with electric power from a second feeding point provided at a second edge portion of the grounding conductor. The third antenna is configured to include a third radiating antenna element, that is formed to be substantially parallel to the second direction, and is fed with electric power from a third feeding point provided at the second edge portion of the grounding conductor. The fourth antenna is configured to include a fourth radiating antenna element, that is formed to be substantially parallel to the first direction, and is fed with electric power from a fourth feeding point provided at a third edge portion of the grounding conductor. The first and fourth antennas are provided to be symmetrical with respect to a predetermined symmetry line on the grounding conductor, and the second and third antennas are arranged to be symmetrical with respect to the symmetry line so that the second and third feeding points are separated apart by a predetermined distance.

Accordingly, the antenna apparatus of the present disclosure can prevent decrease in the gain.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE EMBODIMENTS

Figure 1:
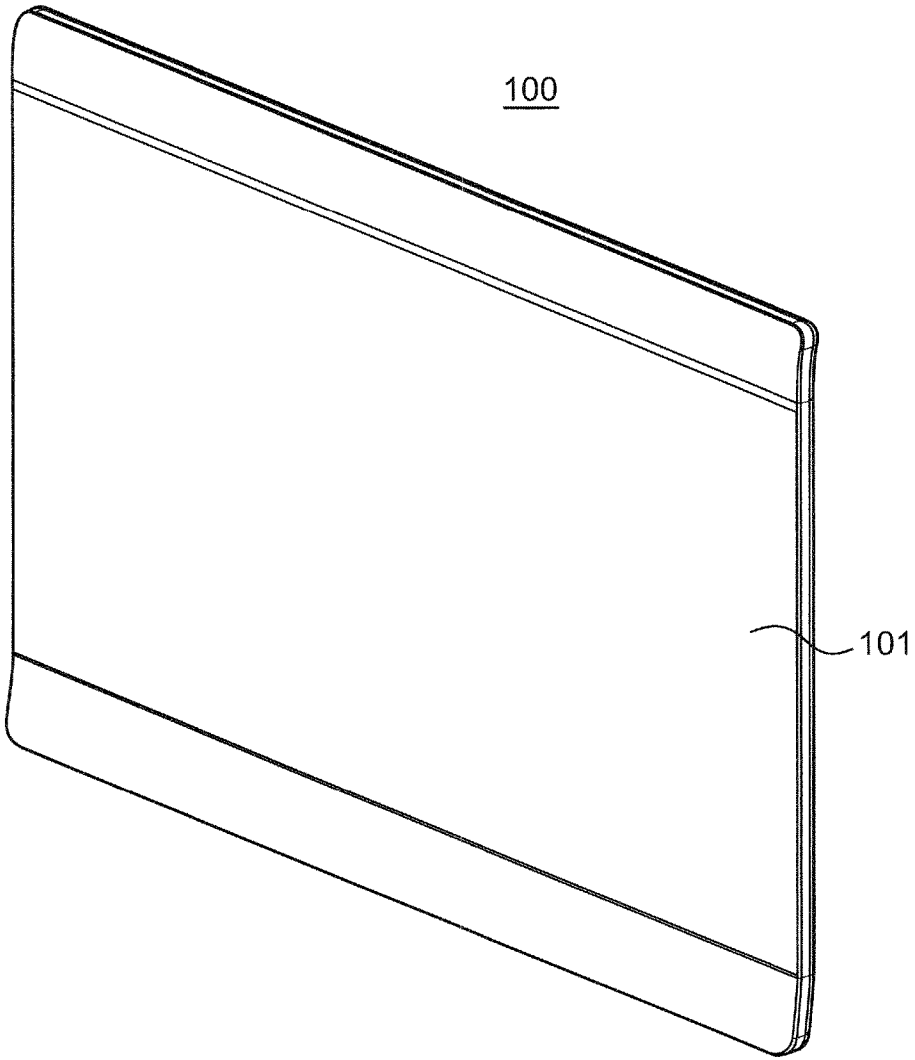
FIG. 1 is a perspective view of an electronic device 100 according to a first embodiment of the present disclosure.

Embodiments will be described in detail below by arbitrarily referring to the drawings. It is noted that detailed description more than necessary are sometimes omitted. For example, detailed description of matters that are already well-known and repetitive explanation for a substantially identical configuration are sometimes omitted. This is to prevent the following description from being unnecessarily redundant and facilitate understanding by those skilled in the art.

The inventor provides the accompanying drawings and the following description so as to make those skilled in the art sufficiently understand the present disclosure, and does not intend to limit the subject described in the claims for patent by them.

Figure 2:
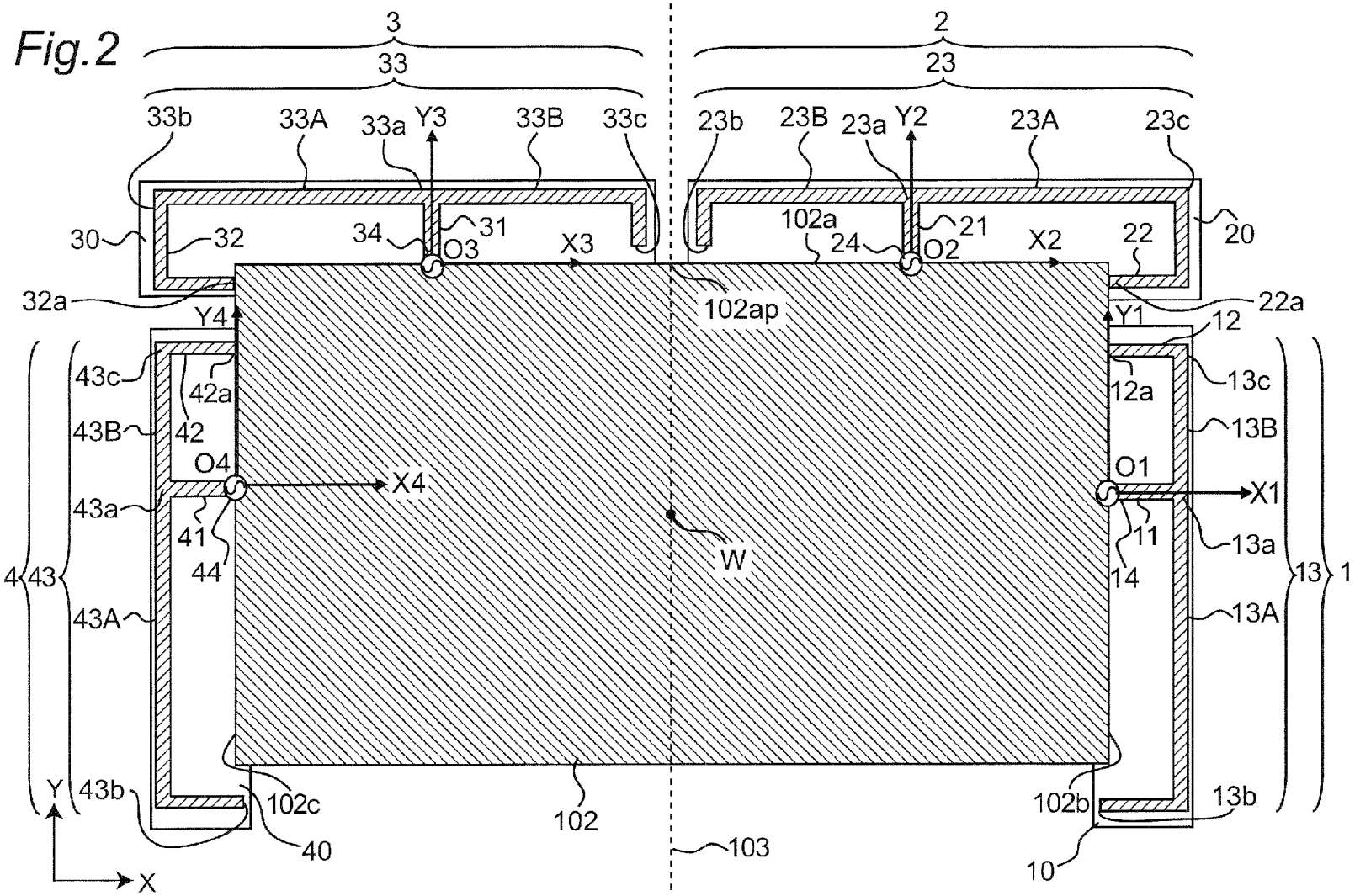
FIG. 2 is a plan view showing antennas 1, 2, 3 and 4 provided for use in the electronic device 100 of FIG. 1 and a grounding conductor 102 of an LCD panel 101 of FIG. 1.
Figure 16:
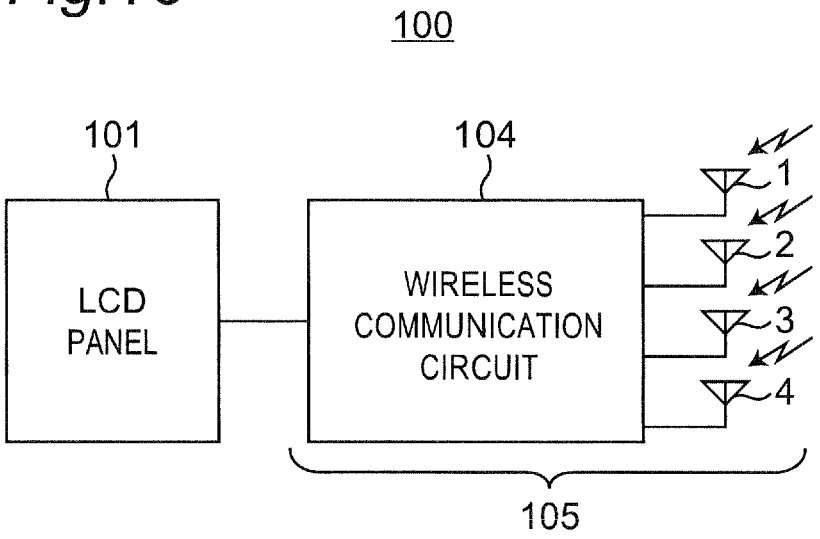
FIG. 16 is a block diagram showing a configuration of the electronic device 100 of FIG. 1.

FIG. 1 is a perspective view of electronic device 100 according to the first embodiment of the present disclosure, and FIG. 16 is a block diagram showing a configuration of the electronic device 100 of FIG. 1. Moreover, FIG. 2 is a plan view showing antennas 1, 2, 3 and 4 provided for use in the electronic device 100 of FIG. 1, and the grounding conductor 102 of the liquid crystal display panel (hereinafter, referred to as LCD) of FIG. 1. Further, FIGS. 3, 4, 5 and 6 are plan views of the antennas 1, 2, and 3 and 4 of FIG. 2, respectively.

Referring to FIGS. 1, 2 and 16, the electronic device 100 of the present embodiment is a portable type television broadcasting receiver apparatus for receiving radio waves in a frequency band (473 MHz to 767 MHz) of the terrestrial digital television broadcasting, and is configured to include an LCD panel 101, and a wireless communication apparatus 105. Moreover, the wireless communication apparatus 105 is configured to include an antenna apparatus including the antennas 1, 2, 3 and 4 and the grounding conductors 102, dielectric substrates 10, 20, 30 and 40, and a wireless communication circuit 104. In this case, as shown in FIG. 1, the LCD panel 101 is provided on the front face of the electronic device 100, and the LCD panel 101 is installed to be substantially perpendicular to the horizontal plane in the electronic device 100. Further, a main circuit board (not shown) for controlling the entire electronic device is built in the electronic device 100. In concrete, the main circuit board is, for example, a printed wiring board, and is configured to include a power supply circuit to supply power voltages to the circuits on the main circuit board, a wireless communication circuit 104 with a tuner, and a driver circuit. In this case, the wireless communication circuit 105 includes a wireless receiver circuit connected to each of the antennas 1 to 4, and operates to perform a polarization diversity process for four received signals from the wireless receiver circuit, combine the received signals into one received signal by weighting them with weights proportional to the signal-to-noise ratio, and output the video signal and the audio signal included in the combined received signal. Moreover, the driver circuit performs predetermined image processing of the video signal from the tuner by driving the LCD panel 101, and displays the resulting image on the LCD panel 101. Further, the electronic device 100 has built-in components such as an audio processing circuit to perform predetermined processing of the audio signal from the wireless communication circuit 104 and output the resulting signal to a loudspeaker, a recording apparatus and a reproducing apparatus for the video signal and the audio signal, and heat-radiating metal members for reducing heat generated from the components of the aforementioned main circuit board and the like.

Referring to FIG. 2, the grounding conductor 102 of the LCD panel 101 is, for example, a conductor plate having a rectangular shape, and has an upside edge portion 102*a*, a right side edge portion 102*b* perpendicular to the upside edge portion 102*a*, and a left side edge portion 102*c* perpendicular to the edge portion 102*a*. Moreover, the dielectric substrate 10 is fixed to the edge portion 102*b*, the dielectric substrates 20 and 30 are fixed side by side to the edge portion 102*a*, and the dielectric substrate 40 is fixed to the edge portion 102*c*. Further, the dielectric substrates 10, 20, 30 and 40 are, for example, printed wiring boards, and are each fixed in an identical plane parallel to the surface of the grounding conductor 102. Moreover, the antenna 1 is provided at the edge portion 102*b*, and the antenna 2 is provided in the right half region of the edge portion 102*a*. The antenna 3 is provided in the left half region of the edge portion 102*a*, and the antenna 4 is provided at the edge portion 102*c*. It is noted that the rightward direction is referred to as an X-axis direction, and the upward direction is referred to as a Y-axis direction of FIG. 2. Further, the direction opposite to the X-axis direction is referred to as a −X-axis direction, and the direction opposite to the Y-axis direction is referred to as a −Y-axis direction. The Y-axis direction is substantially perpendicular to the X-axis direction.

As described in detail later, the antenna apparatus of the present embodiment is configured to include the following:

(a) the antenna 1 configured to include a radiating antenna element 13, that is formed to be substantially parallel to the Y-axis direction and is fed with electric power from a feeding point 14 provided at the edge portion 102*b* of the grounding conductor 102;

(b) the antenna 2 configured to include a radiating antenna element 23, that is formed to be substantially parallel to the X-axis direction and is fed with electric power from a feeding point 24 provided at the edge portion 102*a* of the grounding conductor 102;

(c) the antenna 3 configured to include a radiating antenna element 33, that is formed to be substantially parallel to the X-axis direction and is fed with electric power from a feeding point 34 provided at the edge portion 102*a* of the grounding conductor 102; and (d) the antenna 4 configured to include a radiating antenna element 43, that is formed to be substantially parallel to the Y-axis direction and is fed with electric power from a feeding point 44 provided at the edge portion 102*c* of the grounding conductor 102.

In this case, the antenna apparatus of the present embodiment is characterized in that the antennas 1 and 4 are arranged side by side to be symmetrical with respect to a symmetry line 103 (central perpendicular line) on the grounding conductor 102, and the antennas 2 and 3 are arranged side by side to be symmetrical with respect to the symmetry line 103 so that the feeding points 24 and 34 are separated apart by a predetermined distance. The symmetry line 103 is a symmetry line to divide into two parts, the lengthwise direction of the grounding conductor 102 that is, for example, a conductor plate having a rectangular shape and passes through a weight center W of the conductor plate. In this case, the symmetry line 103 passes through a point 102*ap* to divide the edge portion 102*a* into two parts.

Figure 3:
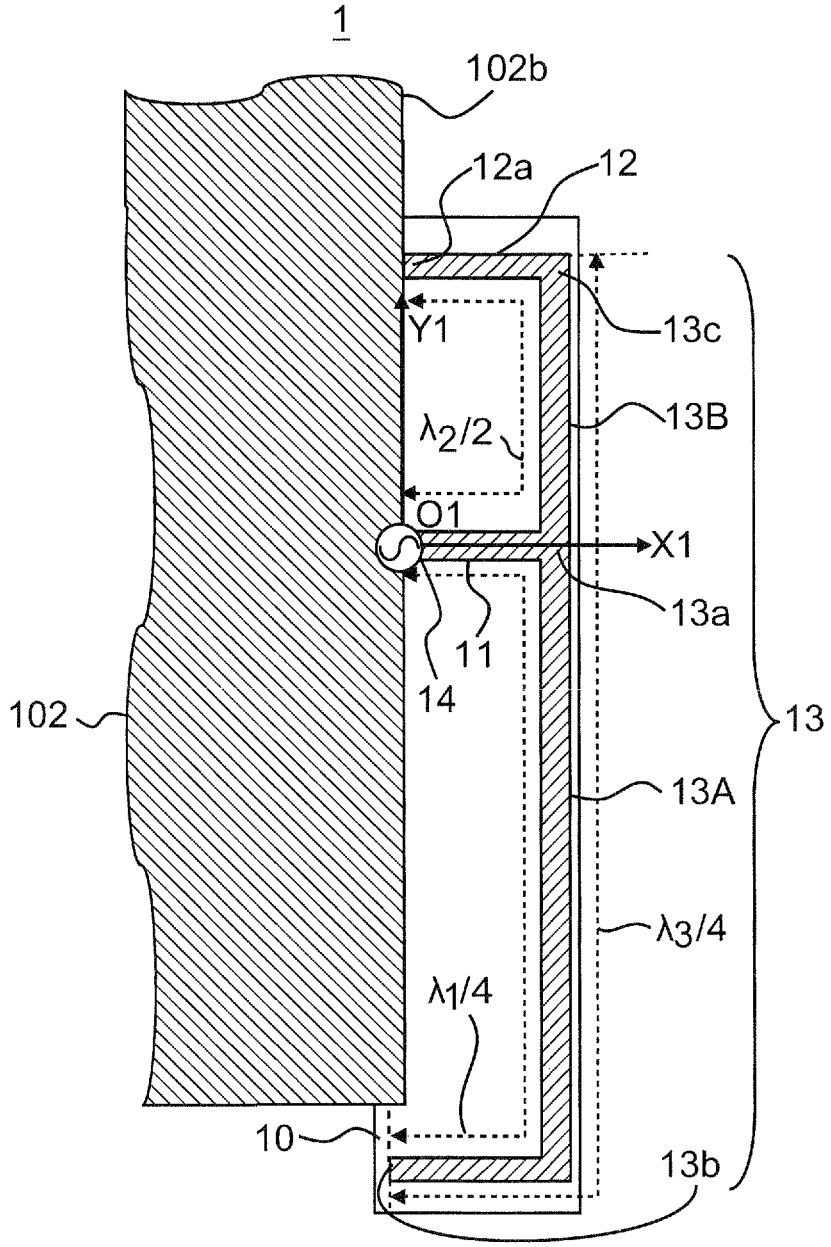
FIG. 3 is a plan view of the antenna 1 of FIG. 2.

Referring to FIG. 3, the antenna 1 is described below by using an X1-Y1 coordinate system having a coordinate origin O1 which is one point on the edge portion on the left side of the dielectric substrate 10, and then, an axis in the upward direction of FIG. 3 along an edge portion on the left side of the dielectric substrate 10 is defined as a Y1 axis, and an axis in the rightward direction of FIG. 3 from the coordinate origin O1 is defined as an X1 axis. In this case, a direction opposite to the X1-axis direction is referred to as a −X1-axis direction, and a direction opposite to the Y1-axis direction is referred to as a −Y1-axis direction. It is noted that the axis Y1 is parallel to the edge portion 102*b*.

Referring to FIG. 3, the antenna 1 is an inverted F antenna, and is configured to include the grounding conductor 102, a feeding antenna element 11, a grounding antenna element 12, a radiating antenna element 13, and the feeding point 14 on the coordinate origin O1. In this case, the feeding antenna element 11, the grounding antenna element 12 and the radiating antenna element 13 are each made of a conductive foil of copper, silver or the like formed on the dielectric substrate 10. It is noted that no grounding conductor is formed on the back surface of the dielectric substrate 10.

Referring to FIG. 3, the feeding antenna element 11 has one end connected to the feeding point 14, and another end connected to the connection point 13*a* of the radiating antenna element 13. The feeding antenna element 11 extends substantially in the X1-axis direction from the feeding point 14 to another end connected to the radiating antenna element 13.

Moreover, referring to FIG. 3, the radiating antenna element 13 is configured to include element portions 13A and 13B that are connected to each other at the connection point 13*a*. Moreover, one end of the element portion 13A is connected to the connection point 13*a*, and another end of the element portion 13A is an open end 13*b*. The element portion 13A is formed to extend from the connection point 13*a* substantially in the −Y1-axis direction along an edge portion of the dielectric substrate 10 and thereafter extend in the −X1-axis direction.

Moreover, the element portion 13B extends from its one end connected to the connection point 13*a* to its other end 13*c* connected to one end of the grounding antenna element 12 substantially in the Y1-axis direction along an edge portion of the dielectric substrate 10. Further, referring to FIG. 3, the grounding antenna element 12 extends from its one end connected to another end 13*c* of the element portion 13B substantially in the −X1-axis direction along an edge portion of the dielectric substrate 10, and another end 12*a* of the grounding antenna element 12 is grounded by being connected to the edge portion 102*b*.

As described above, the antenna 1 is configured to include the grounding antenna element 12 having one end 12*a* connected to the grounding conductor 102, the radiating antenna element 13 that is formed to be substantially parallel to the edge portion 102*b* of the grounding antenna element 12 and has one end 13*c* connected to another end of the grounding antenna element 12, and the open end 13*b*, and the feeding antenna element 11 configured to connect the feeding point 14 with the connection point 13*a* on the radiating antenna element 13.

The antenna 1 configured as described above includes first to third radiating elements. In this case, as shown in FIG. 3, the first radiating element is a monopole antenna configured to include a radiating antenna element that includes a portion extending from the feeding point 14 to the open end 13*b* of the radiating antenna element 13 via the feeding antenna element 11, the connection point 13*a*, and the element portion 13A. The electrical length of the first radiating element is set to $\lambda_1/4$ that is a quarter of wavelength and the first radiating element resonates at a resonance frequency f1 corresponding to the wavelength $\lambda_1$ and is able to receive a wireless signal having a radio frequency of the resonance frequency f1. Moreover, the second radiating element is a loop antenna configured to include a radiating antenna element that includes a portion extending from the feeding point 14 to another end 12*a* of the grounding antenna element 12 via the feeding antenna element 11, the connection point 13*a*, and the element portion 13B. The electrical length of the second radiating element is set to $\lambda_2/2$ that is a half of wavelength $\lambda_2$, and the second radiating element resonates at a resonance frequency f2 corresponding to the wavelength $\lambda_2$ and is able to receive a wireless signal having a radio frequency of the resonance frequency f2.

Further, referring to FIG. 3, the third radiating element is a conductor-loaded monopole antenna configured to include a radiating antenna element that includes a portion extending from the open end 13*b* of the radiating antenna element 13 to another end 13*c* of the radiating antenna element 13 via the element portions 13A and 13B. The third radiating element is fed with electric power for excitation at the connection point 13*a* with the feeding antenna element 11 used as a feeding line. Moreover, the electrical length of the third radiating element is set to $\lambda_3/4$ that is a quarter of wavelength $\lambda_3$, and the third radiating element resonates at a resonance frequency f3 corresponding to the wavelength $\lambda_3$ and is able to receive the wireless signal having a radio frequency of the resonance frequency f3.

The antenna 1 configured as described above receives vertically polarized radio waves parallel to the X1-axis direction. When the radio waves are received by the antenna 1, a received signal received by the antenna 1 is outputted to the wireless communication circuit 104 via the feeding point 14 and a feeder cable.

Figure 4:
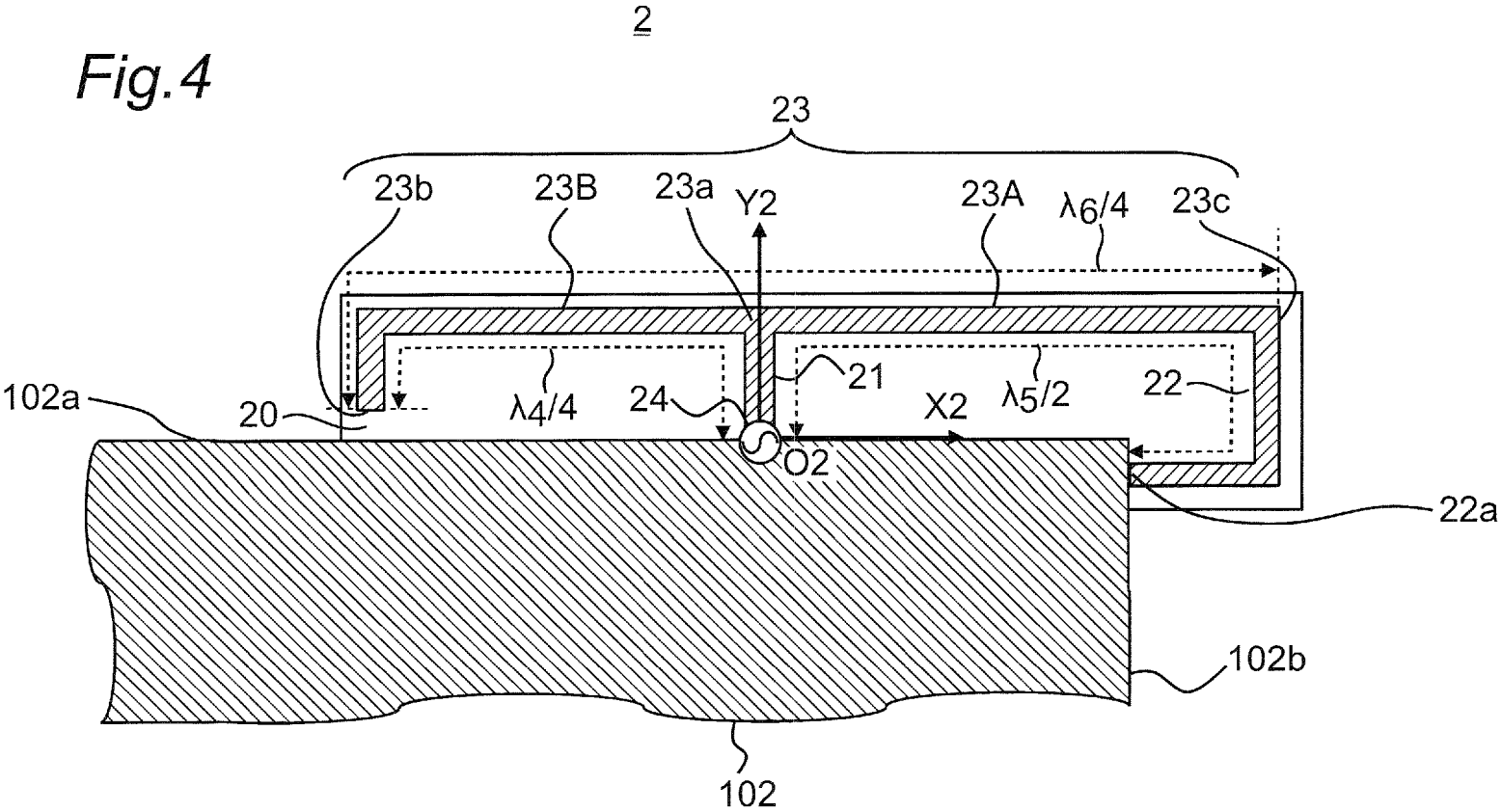
FIG. 4 is a plan view of the antenna 2 of FIG. 2.

Referring to FIG. 4, the antenna 2 is described below by using an X2-Y2 coordinate system in which one point on the downside edge portion of the dielectric substrate 20 is assumed to be a coordinate origin O2. An axis in the rightward direction of FIG. 4 along the downside edge portion of the dielectric substrate 20 is assumed to be an X2 axis, and an axis in the upward direction of FIG. 4 from the coordinate origin O2 is assumed to be a Y2 axis. In this case, a direction opposite to the X2 axis is referred to as a −X2 direction, and a direction opposite to the Y2 axis is referred to as a −Y2 direction. It is noted that the X2 axis is parallel to the edge portion 102*a*.

Referring to FIG. 4, the antenna 2 is an inverted F antenna, and is configured to include the grounding conductor 102, a feeding antenna element 21, a grounding antenna element 22, a radiating antenna element 23, and a feeding point 24 on the coordinate origin O2. In this case, the feeding antenna element 21, the grounding antenna element 22 and the radiating antenna element 23 are each made of a conductive foil of copper, silver or the like formed on the dielectric substrate 20. It is noted that no grounding conductor is formed on the back surface of the dielectric substrate 20.

Referring to FIG. 4, the feeding antenna element 21 has one end connected to the feeding point 24, and another end connected to the connection point 23*a* of the radiating antenna element 23. The feeding antenna element 21 extends substantially in the Y2-axis direction from the feeding point 24 to another end connected to the radiating antenna element 23.

Moreover, referring to FIG. 4, the radiating antenna element 23 is configured to include element portions 23A and 23B that are connected to each other at the connection point 23*a*. The element portion 23A extends substantially in the X2-axis direction along an edge portion of the dielectric substrate 20 from its one end connected to the connection point 23*a* to its other end 23*c* connected to one end of the grounding antenna element 22. Moreover, one end of the element portion 23B is connected to the connection point 23*a*, and another end of the element portion 23B is an open end 23*b*. The element portion 23B is formed to extend from the connection point 23*a* substantially in the −X2-axis direction along an edge portion of the dielectric substrate 10, and thereafter extend in the −Y2-axis direction.

Further, the grounding antenna element 22 extends substantially in the −X2-axis direction along an edge portion of the dielectric substrate 20 from its one end connected to another end 23*c* of the element portion 23A, and thereafter extends substantially in the −Y2-axis direction along an edge portion of the dielectric substrate 20, while another end 22*a* of the grounding antenna element 22 is grounded by being connected to the edge portion 102*b*.

As described above, the antenna 2 is configured to include the grounding antenna element 22 having one end 22*a* connected to the grounding conductor 102, the radiating antenna element 23 that is formed to be substantially parallel to the edge portion 102*a* of the grounding conductor 102 and has one end 23*c* connected to another end of the grounding antenna element 22 and the open end 23*b*, and the feeding antenna element 21 configured to connect the feeding point 24 with the connection point 23*a* on the radiating antenna element 23.

The antenna 2 configured as described above includes fourth to sixth radiating elements. In this case, as shown in FIG. 4, the fourth radiating element is a monopole antenna configured to include a radiating antenna element that includes a portion extending from the feeding point 24 to the open end 23*b* of the radiating antenna element 23 via the feeding antenna element 21, the connection point 23*a*, and the element portion 23B. The electrical length of the fourth radiating element is set to $\lambda_4/4$ that is a quarter of wavelength $\lambda_4$, and the fourth radiating element resonates at a resonance frequency f4 corresponding to the wavelength $\lambda$4 and is able to receive a wireless signal having a radio frequency of the resonance frequency f4. Moreover, the fifth radiating element is a loop antenna configured to include a radiating antenna element that includes a portion extending from the feeding point 24 to another end 22*a* of the grounding antenna element 22 via the feeding antenna element 21, the element portion 23A, and the grounding antenna element 22. The electrical length of the fifth radiating element is set to $\lambda_5/2$ that is a half of wavelength $\lambda_5$, and the fifth radiating element resonates at a resonance frequency f5 corresponding to the wavelength $\lambda_5$ and is able to receive a wireless signal having a radio frequency of the resonance frequency f5.

Further, referring to FIG. 4, the sixth radiating element is a conductor-loaded monopole antenna configured to include a radiating antenna element that includes a portion extending from the open end 23*b* of the radiating antenna element 23 to another end 23*c* of the radiating antenna element 23 via the element portions 23B and 23A. The sixth radiating element is fed with electric power for excitation at the connection point 23*a* with the feeding antenna element 21 used as a feeding line. Moreover, the electrical length of the sixth radiating element is set to $\lambda_6/4$ that is a quarter of wavelength $\lambda_6$, and the sixth radiating element resonates at a resonance frequency f6 corresponding to the wavelength $\lambda_6$ and is able to receive a wireless signal having a radio frequency of the resonance frequency f6.

The antenna 2 configured as described above receives vertically polarized radio waves having a polarization direction parallel to the Y2-axis direction. When the radio waves are received by the antenna 2, a received signal received by the antenna 2 is outputted to the wireless communication circuit 104 via the feeding point 24 and a feeder cable.

Figure 5:
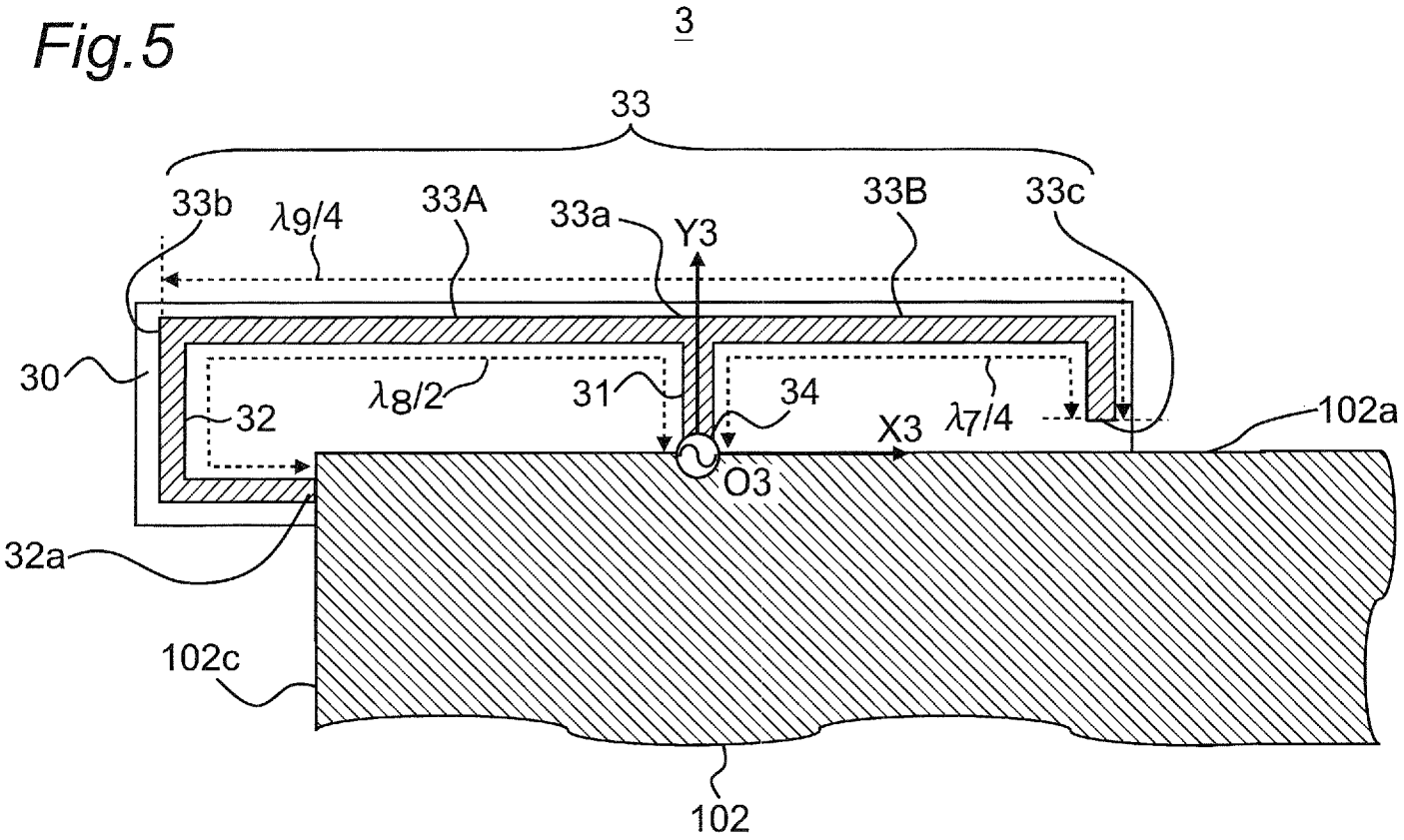
FIG. 5 is a plan view of the antenna 3 of FIG. 2.

Referring to FIG. 5, the antenna 3 is described below by using a X3-Y3 coordinate system in which one point on the downside edge portion of the dielectric substrate 30 is assumed to be a coordinate origin O3. An axis in the rightward direction of FIG. 5 along the downside edge portion of the dielectric substrate 30 is assumed to be an X3 axis, and an axis in the upward direction of FIG. 5 from the coordinate origin O3 is assumed to be a Y3 axis. In this case, a direction opposite to the X3-axis direction is referred to as a −X3 axis direction, and a direction opposite to the Y3-axis direction is referred to as a −Y3-axis direction. It is noted that the X3 axis is parallel to the edge portion 102*a*.

Referring to FIG. 5, the antenna 3 is an inverted F antenna, and is configured to include the grounding conductor 102, a feeding antenna element 31, a grounding antenna element 32, a radiating antenna element 33, and a feeding point 34 on the coordinate origin O3. In this case, the feeding antenna element 31, the grounding antenna element 32, and the radiating antenna element 33 are each made of a conductive foil of copper, silver or the like formed on the dielectric substrate 30. It is noted that no grounding conductor is formed on the back surface of the dielectric substrate 30.

Referring to FIG. 5, the feeding antenna element 31 has one end connected to the feeding point 34, and another end connected to the connection point 33*a* of the radiating antenna element 33. The feeding antenna element 31 extends substantially in the Y3-axis direction from the feeding point 34 to another end connected to the radiating antenna element 33.

Referring to FIG. 5, the radiating antenna element 33 is configured to include element portions 33A and 33B that are connected to each other at the connection point 33*a*. Moreover, the element portion 33A extends substantially in the −X3-axis direction along an edge portion of the dielectric substrate 30 from one end connected to the connection point 33*a* to another end 33*b* connected to one end of the grounding antenna element 32. Moreover, one end of the element portion 33B is connected to the connection point 33*a*, and another end of the element portion 33B is an open end 33*c*. The element portion 33B is formed to extend from the connection point 33*a* substantially in the X3-axis direction along an edge portion of the dielectric substrate 30, and thereafter extend in the −Y3-axis direction.

Further, referring to FIG. 5, the grounding antenna element 32 extends from its one end connected to another end 33*b* of the element portion 33A substantially in the −Y3-axis direction along an edge portion of the dielectric substrate 10, and thereafter extends substantially in the X3-axis direction along an edge portion of the dielectric substrate 30, while another end 32*a* of the grounding antenna element 32 is grounded by being connected to the edge portion 102*c*.

As described above, the antenna 3 is configured to include the grounding antenna element 32 having one end 32*a* connected to the grounding conductor 102, the radiating antenna element 33 that is formed to be substantially parallel to the edge portion 102*a* of the grounding conductor 102 and has one end 33*b* connected to another end of the grounding antenna element 32, and the open end 33*c*, and the feeding antenna element 31 configured to connect the feeding point 34 with the connection point 33*a* on the radiating antenna element 33.

The antenna 3 configured as described above includes seventh to ninth radiating elements. In this case, as shown in FIG. 5, the seventh radiating element is a monopole antenna configured to include a radiating antenna element that includes a portion extending from the feeding point 34 to the open end 33*c* of the radiating antenna element 33 via the feeding antenna element 31, the connection point 33*a*, and the element portion 33B. The electrical length of the seventh radiating element is set to $\lambda_7/4$ that is a quarter of wavelength $\lambda_7$, and the seventh radiating element resonates at a resonance frequency f7 corresponding to the wavelength $\lambda_7$ and is able to receive a wireless signal having a radio frequency of the resonance frequency f7. Moreover, the eighth radiating element is a loop antenna configured to include a radiating antenna element that includes a portion extending from the feeding point 34 to another end 32*a* of the grounding antenna element 32 via the feeding antenna element 31, the element portion 33A, and the grounding antenna element 32. The electrical length of the eighth radiating element is set to $\lambda_8/2$ that is a half of wavelength $\lambda_8$, and the eighth radiating element resonates at a resonance frequency f8 corresponding to the wavelength $\lambda_8$ and is able to receive a wireless signal having a radio frequency of the resonance frequency f8.

Further, referring to FIG. 5, the ninth radiating element is a conductor-loaded monopole antenna configured to include a radiating antenna element that includes a portion extending from the open end 33*c* of the radiating antenna element 33 to another end 33*b* of the radiating antenna element 33 via the element portions 33B and 33A. The ninth radiating element is fed with electric power for excitation at the connection point 33*a* with the feeding antenna element 31 used as a feeding line. Moreover, the electrical length of the ninth radiating element is set to $\lambda_9/4$ that is a quarter of wavelength $\lambda_9$, and the ninth radiating element resonates at a resonance frequency f9 corresponding to the wavelength $\lambda_9$ and is able to receive a wireless signal having a radio frequency of the resonance frequency f9.

The antenna 3 configured as described above receives vertically polarized radio waves having a polarization direction parallel to the Y3-axis direction. When the radio waves are received by the antenna 3, a received signal received by the antenna 3 is outputted to the wireless communication circuit 104 via the feeding point 34 and a feeder cable.

Figure 6:
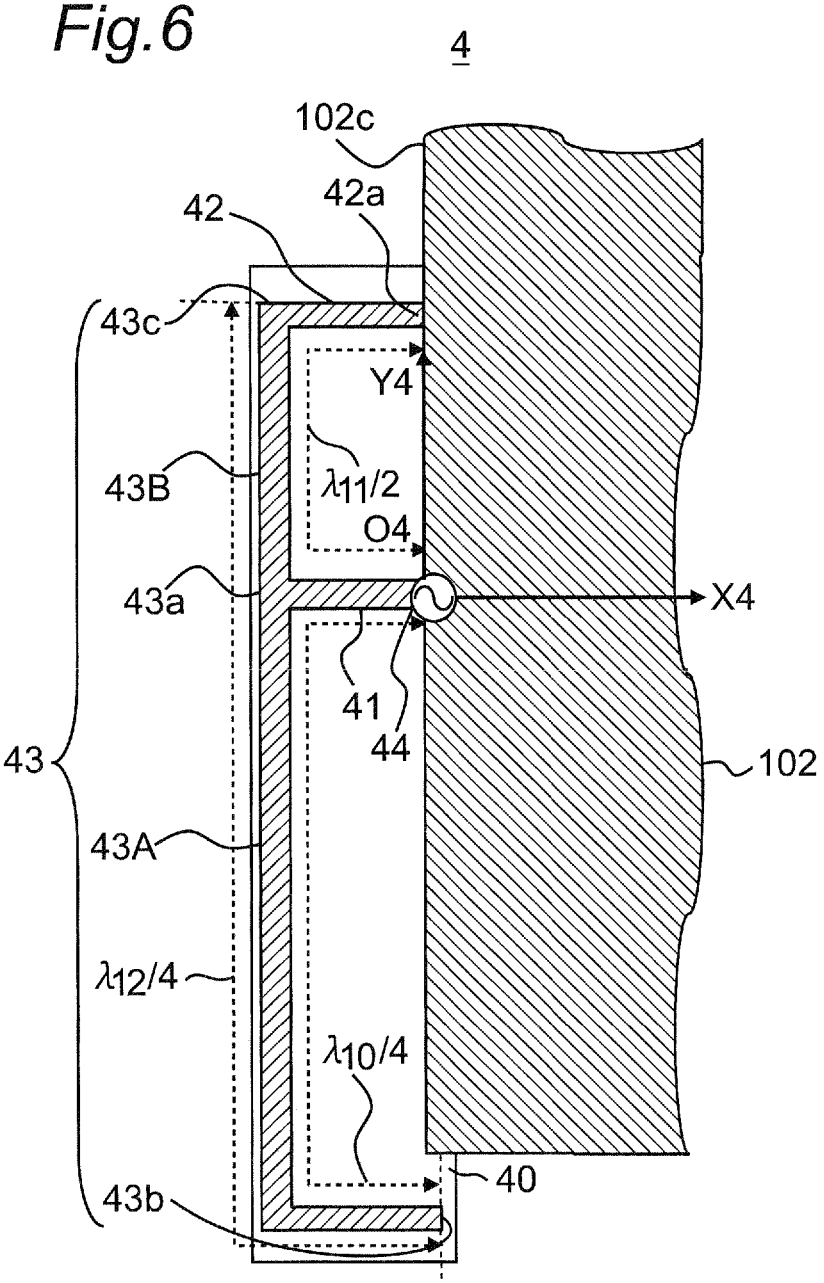
FIG. 6 is a plan view of the antenna 4 of FIG. 2.
Figure 7:
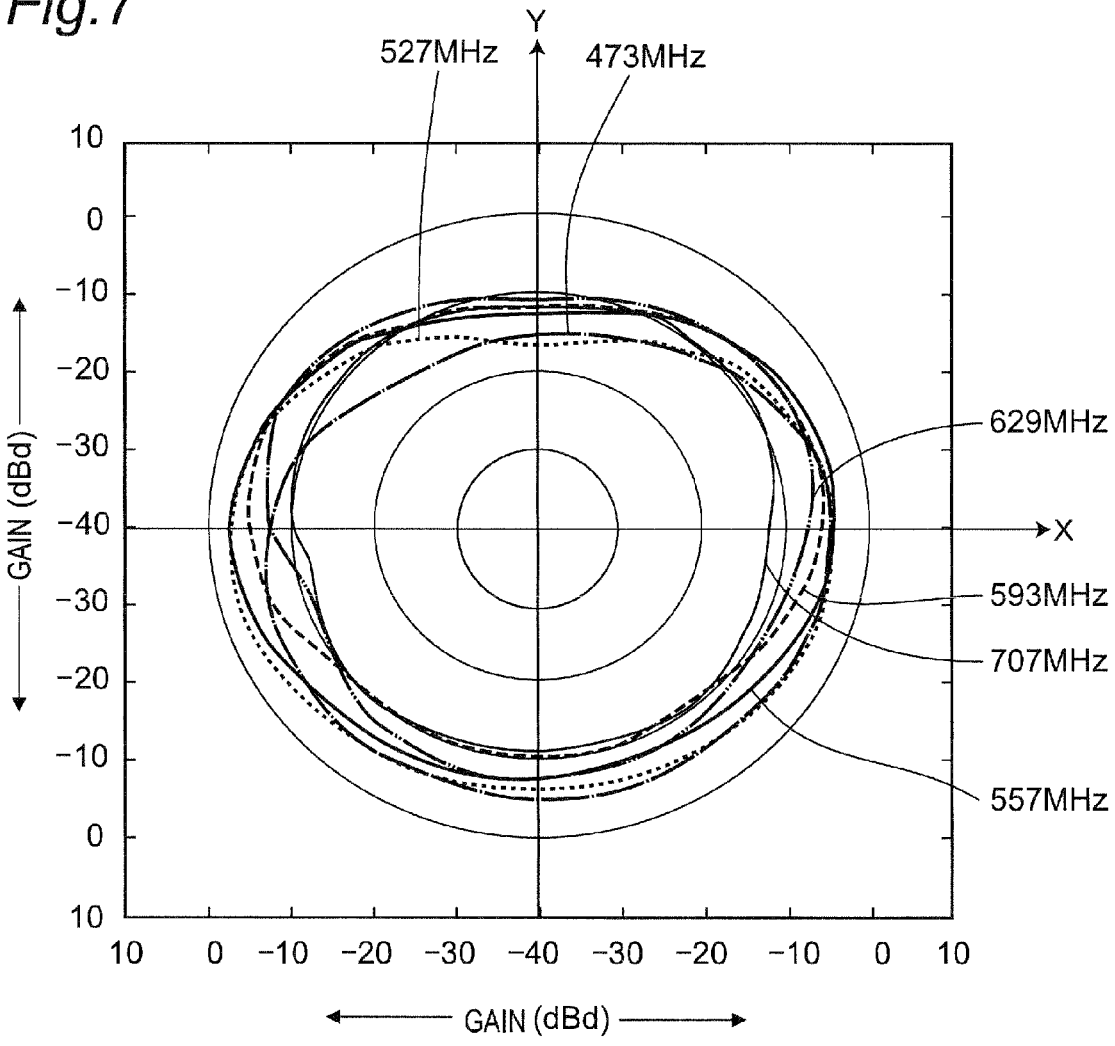
FIG. 7 is a graph showing directional patterns of vertically polarized radio waves of the antenna 1 of FIG. 2.
Figure 8:
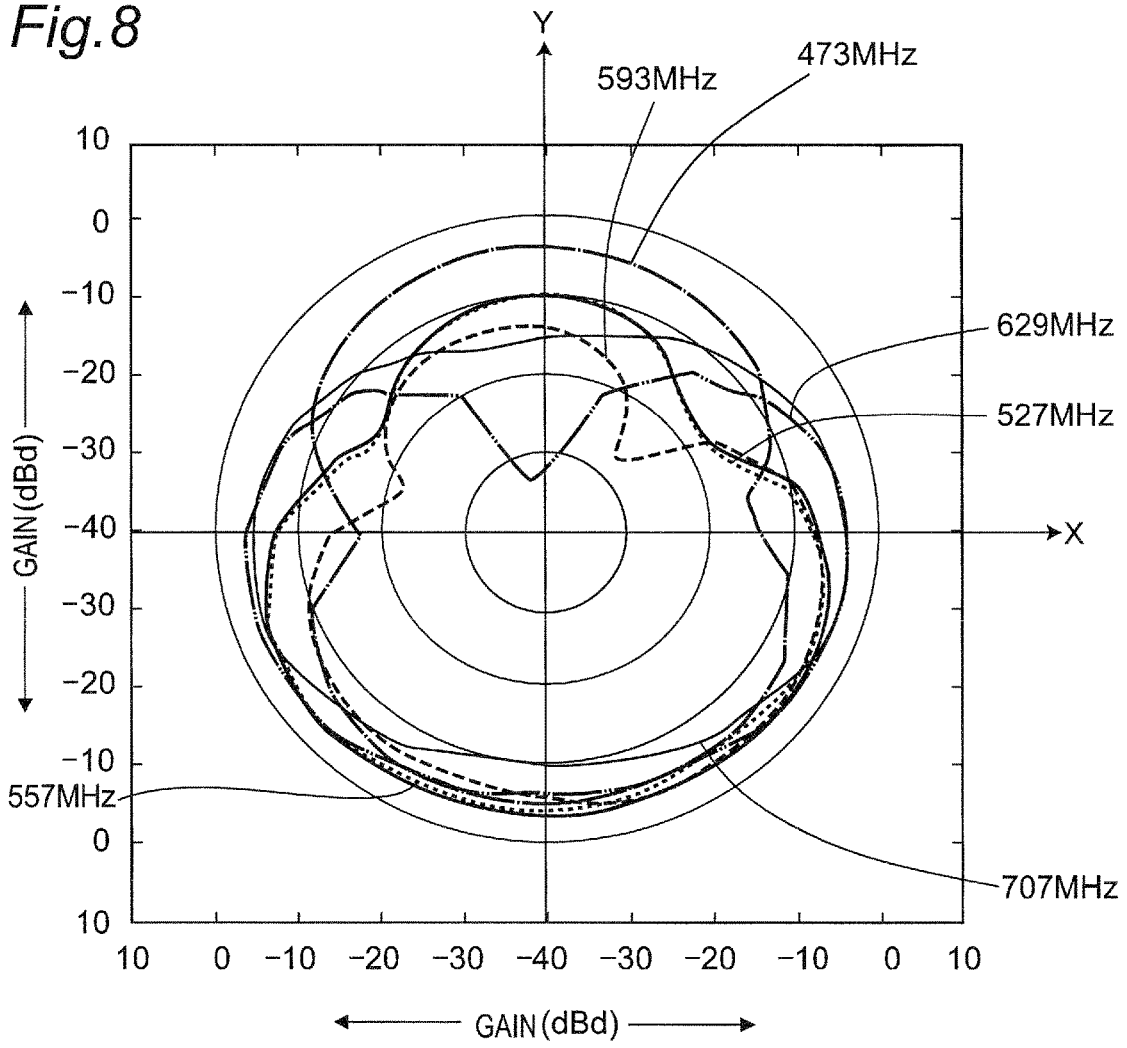
FIG. 8 is a graph showing directional patterns of the vertically polarized radio waves of the antenna 2 of FIG. 2.
Figure 9:
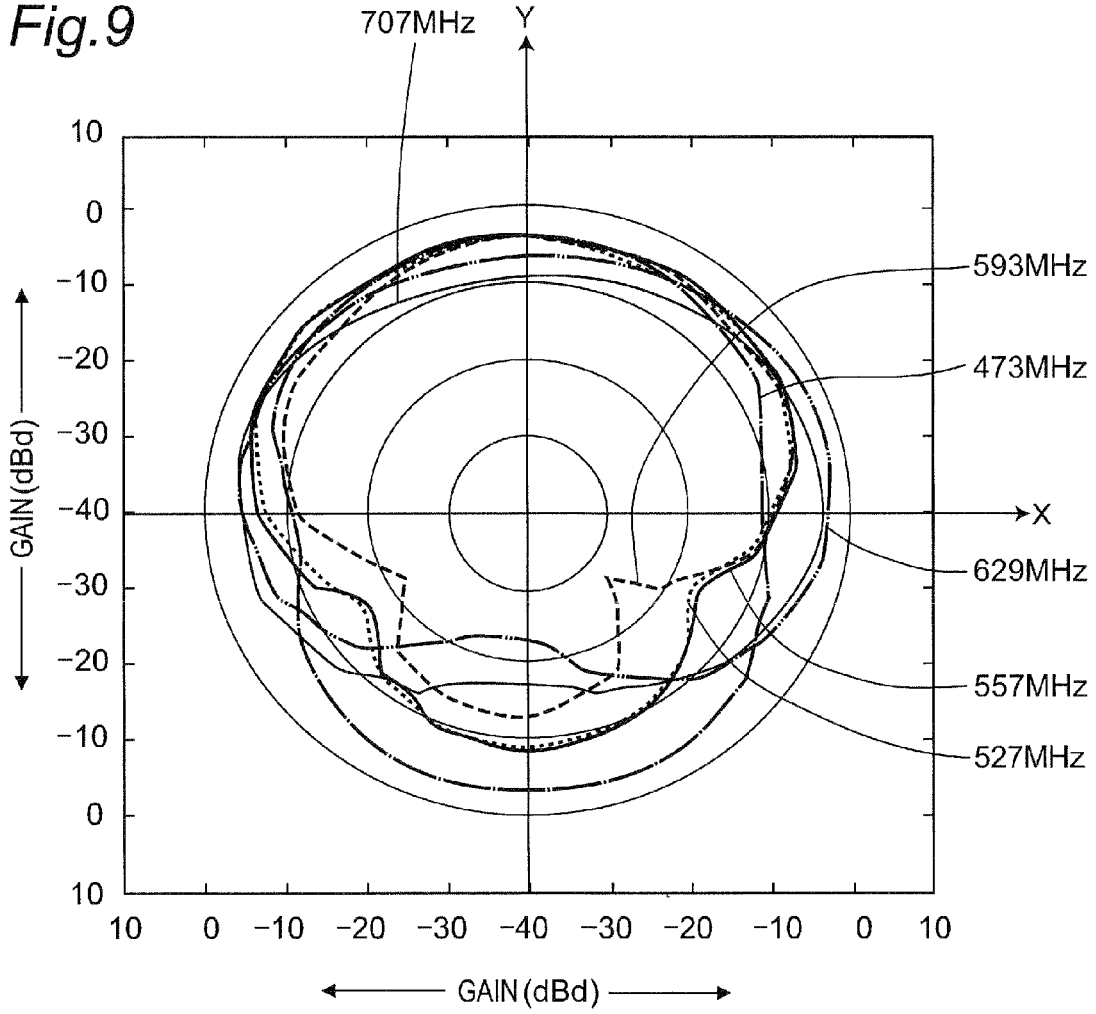
FIG. 9 is a graph showing directional patterns of the vertically polarized radio waves of the antenna 3 of FIG. 2.
Figure 10:
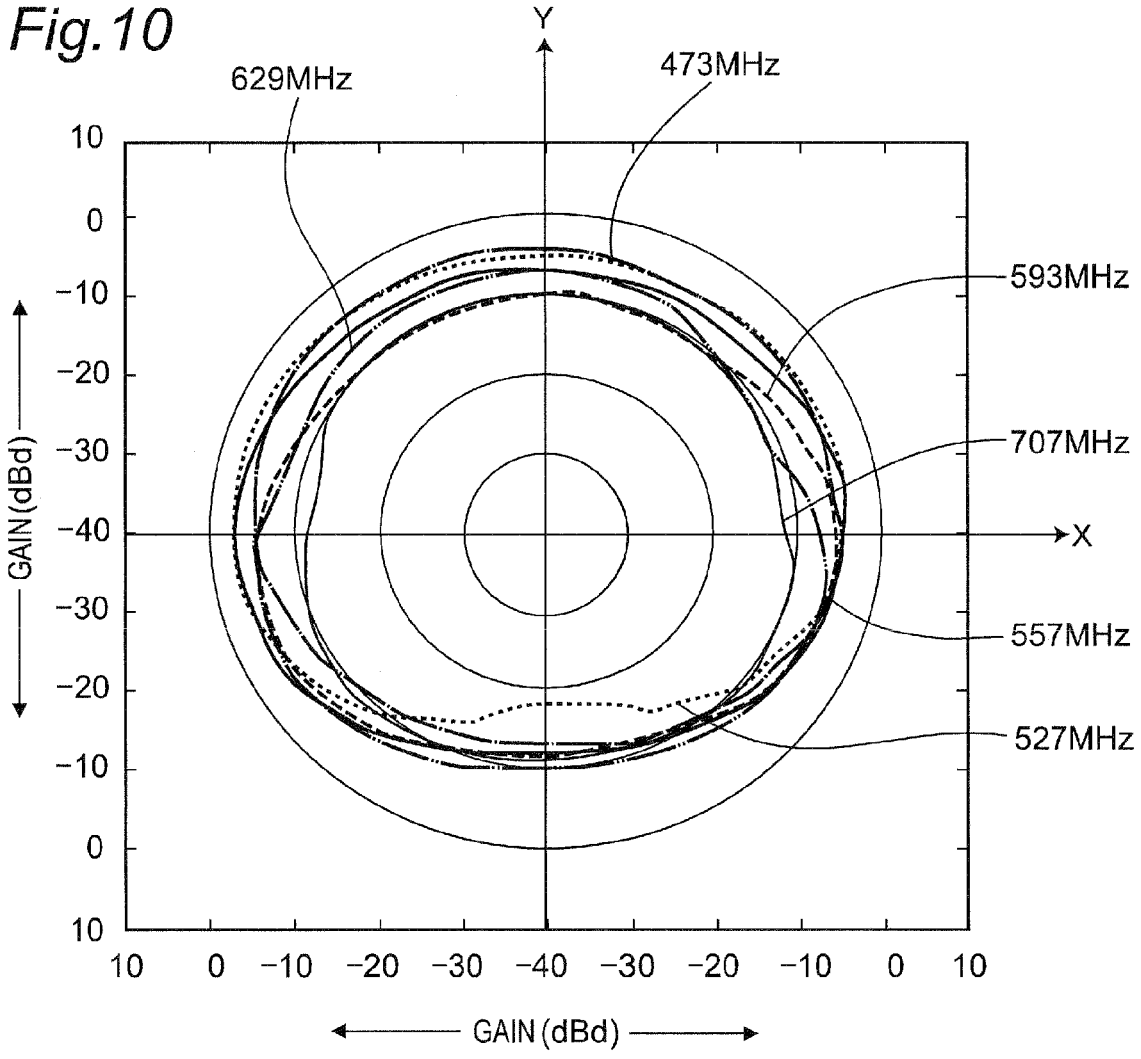
FIG. 10 is a graph showing directional patterns of the vertically polarized radio waves of the antenna 4 of FIG. 2.
Figure 11:
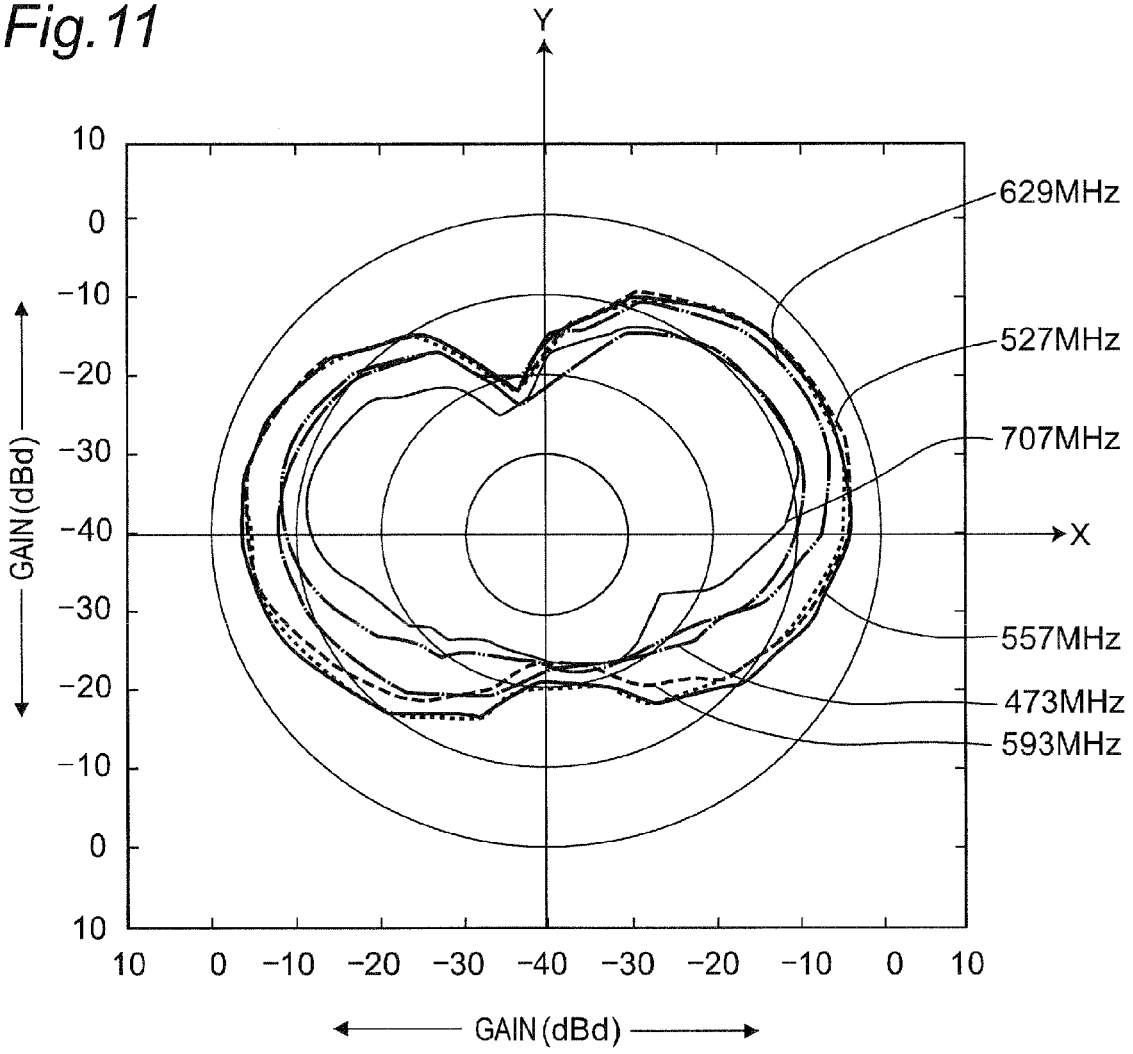
FIG. 11 is a graph showing directional patterns of the horizontally polarized radio waves of the antenna 1 of FIG. 2.
Figure 12:
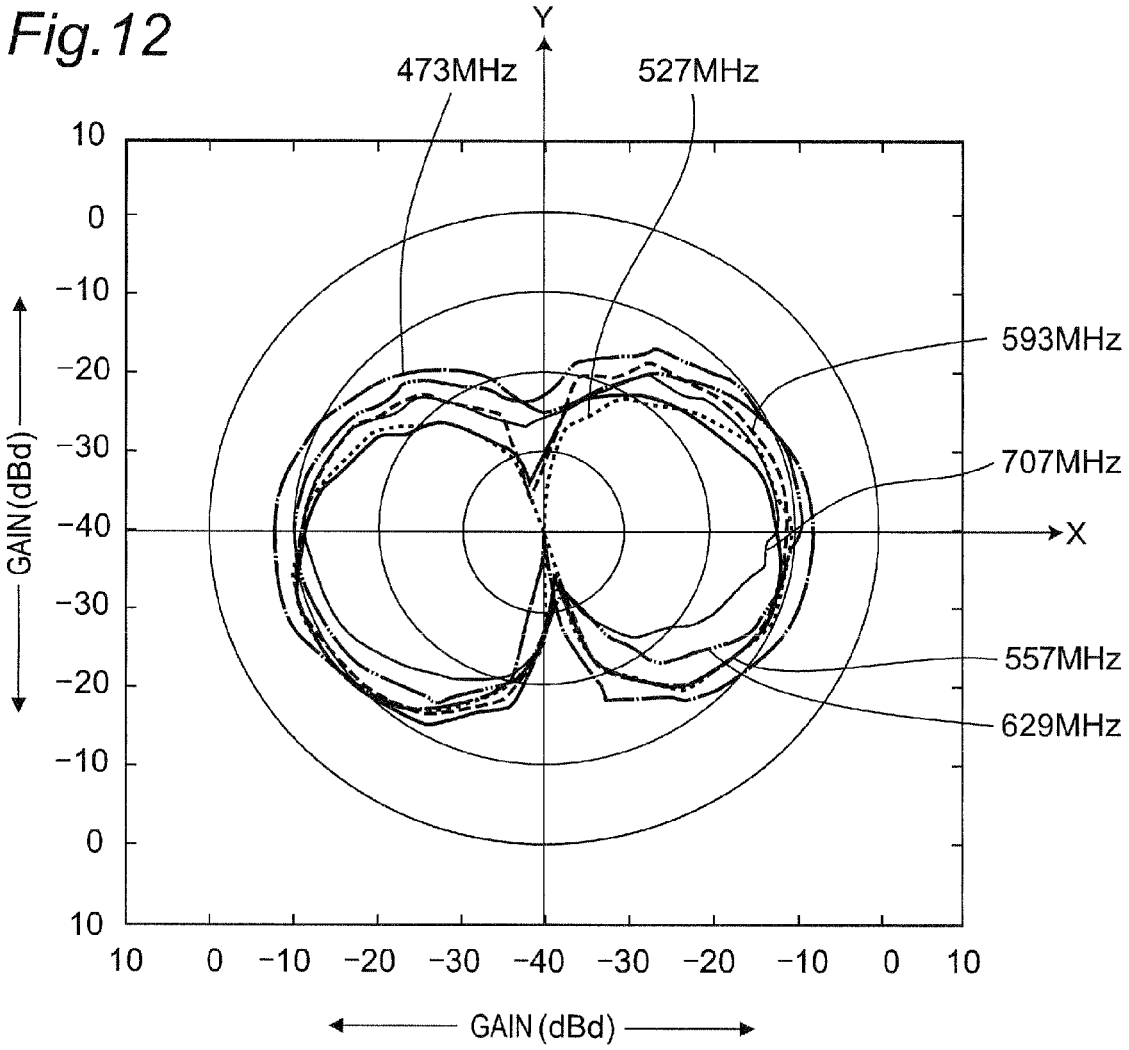
FIG. 12 is a graph showing directional patterns of the horizontally polarized radio waves of the antenna 2 of FIG. 2.
Figure 13:
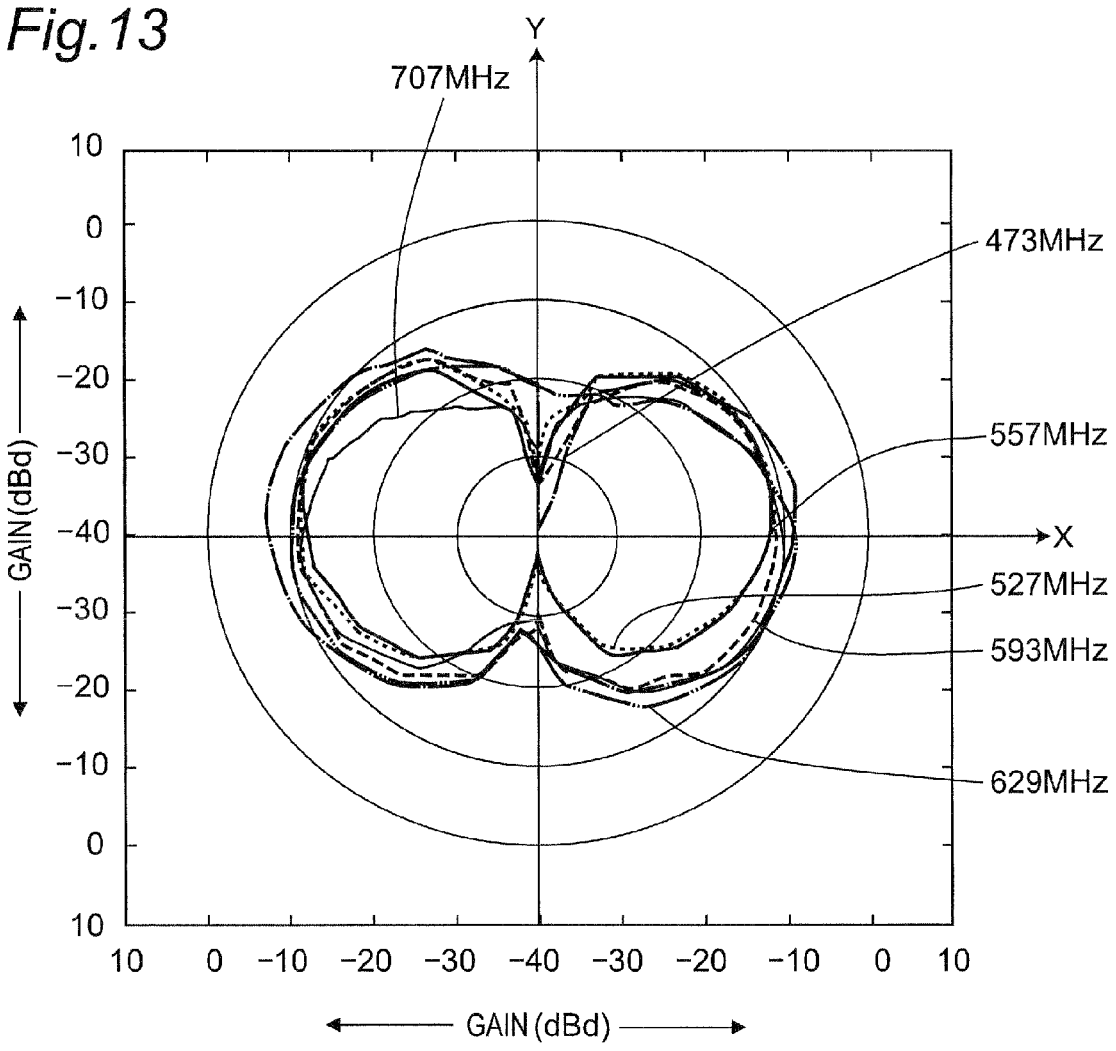
FIG. 13 is a graph showing directional patterns of the horizontally polarized radio waves of the antenna 3 of FIG. 2.
Figure 14:
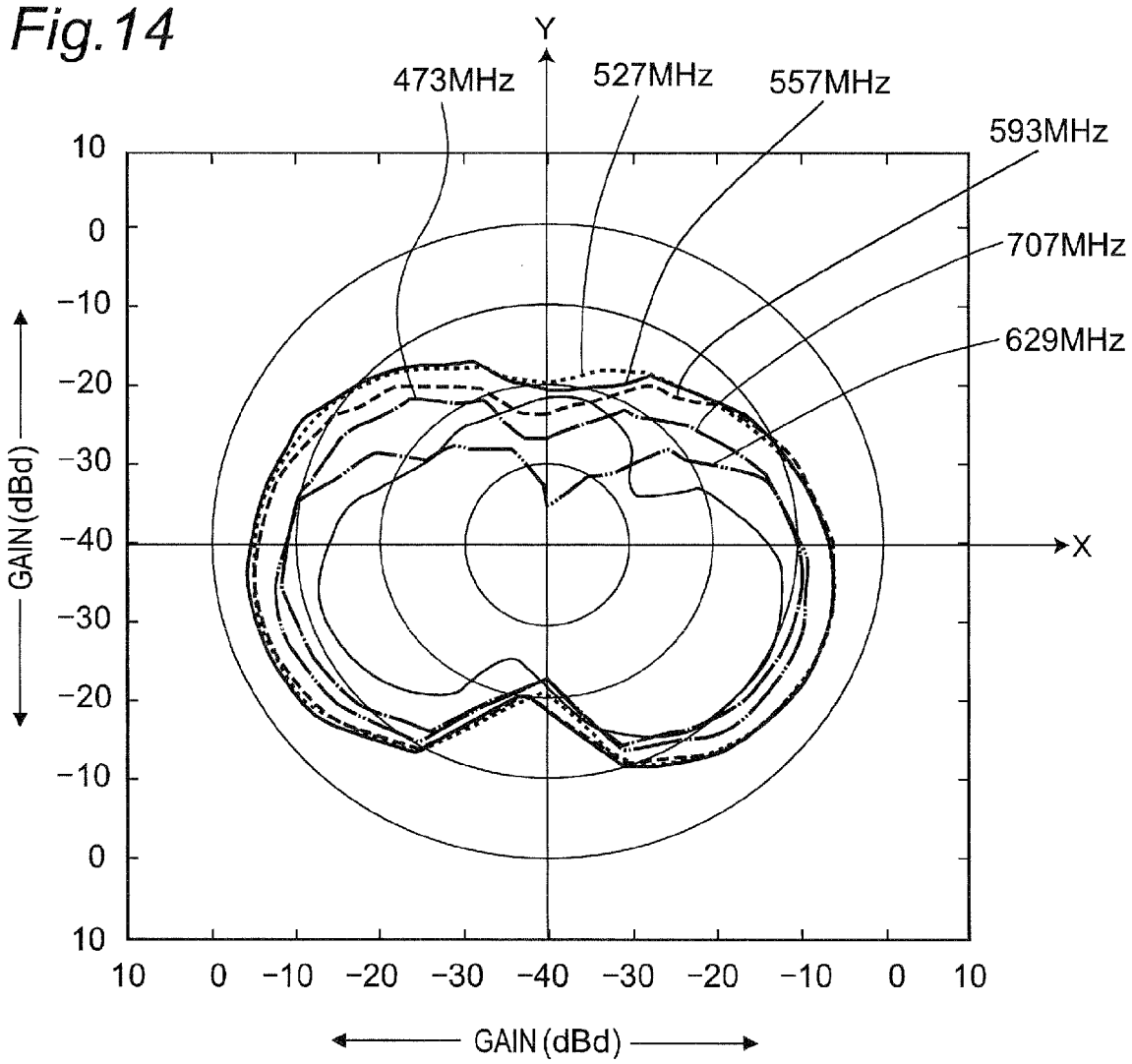
FIG. 14 is a graph showing directional patterns of the horizontally polarized radio waves of the antenna 4 of FIG. 2.

Referring to FIG. 6, the antenna 4 is described below by using an X4-Y4 coordinate system in which one point on the edge portion on the right side of the dielectric substrate 40 is assumed to be a coordinate origin O4. An axis in the upward direction of FIG. 6 along an edge portion on the right side of the dielectric substrate 40 is assumed to be a Y4 axis, and an axis in the rightward direction of FIG. 6 from the coordinate origin O4 is assumed to be an X4 axis. In this case, a direction opposite to the X4-axis direction is referred to as a −X4 axis direction, and a direction opposite to the Y4 axis is referred to as a −Y4-axis direction. It is noted that the Y4 axis is parallel to the edge portion 102*c*.

Referring to FIG. 6, the antenna 4 is an inverted F antenna, and is configured to include the grounding conductor 102, a feeding antenna element 41, a grounding antenna element 42, a radiating antenna element 43, and a feeding point 44 on the coordinate origin O4. In this case, the feeding antenna element 41, the grounding antenna element 42 and the radiating antenna element 43 are each made of a conductive foil of copper, silver or the like formed on the dielectric substrate 40. It is noted that no grounding conductor is formed on the back surface of the dielectric substrate 40.

Referring to FIG. 6, the feeding antenna element 41 has one end connected to the feeding point 44, and another end connected to the connection point 43*a* of the radiating antenna element 43. The feeding antenna element 41 extends substantially in the −X4-axis direction from the feeding point 44 to another end connected to the radiating antenna element 43.

Moreover, referring to FIG. 6, the radiating antenna element 43 is configured to include element portions 43A and 43B that are connected to each other at the connection point 43*a*. Moreover, one end of the element portion 43A is connected to the connection point 43*a*, and another end of the element portion 43A is an open end 43*b*. The element portion 43A is formed to extend from the connection point 43*a* substantially in the −Y4-axis direction along an edge portion of the dielectric substrate 40, and thereafter extend in the X4-axis direction.

Moreover, the element portion 43B extends substantially in the Y4-axis direction along an edge portion of the dielectric substrate 40 from its one end connected to the connection point 43*a* to its other end 43*c* connected to one end of the grounding antenna element 42. Further, referring to FIG. 6, the grounding antenna element 42 extends from its one end connected to another end 43*c* of the element portion 43B substantially in the X4-axis direction along an edge portion of the dielectric substrate 40, while another end 42*a* of the grounding antenna element 42 is grounded by being connected to the edge portion 102*c*.

As described above, the antenna 4 is configured to include the grounding antenna element 42 having one end 42*a* connected to the grounding conductor 102, the radiating antenna element 43 that is formed to be substantially parallel to the edge portion 102*c* of the grounding conductor 102 and has one end 43*c* connected to another end of the grounding antenna element 42, and the open end 43*b*, and the feeding antenna element 41 configured to connect the feeding point 44 with the connection point 43*a* on the radiating antenna element 43.

The antenna 4 configured as described above includes tenth to twelfth radiating elements. In this case, as shown in FIG. 6, the tenth radiating element is a monopole antenna configured to include a radiating antenna element that includes a portion extending from the feeding point 44 to the open end 43*b* of the radiating antenna element 43 via the feeding antenna element 41, the connection point 43*a*, and the element portion 43A. The electrical length of the tenth radiating element is set to $\lambda_{10}/4$ that is a quarter of wavelength $\lambda_{10}$, and the tenth radiating element resonates at a resonance frequency f10 corresponding to the wavelength $\lambda_{10}$ and is able to receive a wireless signal having a radio frequency of the resonance frequency f10. Moreover, the eleventh radiating element is a loop antenna configured to include a radiating antenna element that includes a portion extending from the feeding point 44 to another end 42*a* of the grounding antenna element 42 via the feeding antenna element 41, the connection point 43*a*, the element portion 43B, and the grounding antenna element 42. The electrical length of the eleventh radiating element is set to $\lambda_{11}/2$ that is a half of wavelength $\lambda_{11}$, and the eleventh radiating element resonates at a resonance frequency f11 corresponding to the wavelength $\lambda_{11}$ and is able to receive a wireless signal having a radio frequency of the resonance frequency f11.

Further, referring to FIG. 6, the twelfth radiating element is a conductor-loaded monopole antenna configured to include a radiating antenna element that includes a portion extending from the open end 43*b* of the radiating antenna element 43 to another end 43*c* of the radiating antenna element 43 via the element portions 43A and 43B. The twelfth radiating element is fed with electric power for excitation at the connection point 43*a* with the feeding antenna element 41 used as a feeding line. Moreover, the electrical length of the twelfth radiating element is set to $\lambda_{12}/4$ that is a quarter of wavelength $\lambda_{12}$, and the twelfth radiating element resonates at a resonance frequency f12 corresponding to the wavelength $\lambda_{12}$ and is able to receive a wireless signal having a radio frequency of the resonance frequency f12.

The antenna 4 configured as described above receives horizontally polarized radio waves parallel to the X4-axis direction. When the radio waves are received by the antenna 4, a received signal received by the antenna 4 is outputted to the wireless communication circuit 104 via the feeding point 44 and a feeder cable.

FIGS. 7 to 10 are graphs showing directional patterns of the vertically polarized radio waves of the antennas 1 to 4 of FIG. 2, respectively. Moreover, FIGS. 11 to 14 are graphs showing directional patterns of the horizontally polarized radio waves of the antennas 1 to 4 of FIG. 2, respectively. As shown in FIGS. 7 to 10, the directional patterns of the vertically polarized radio waves of the antenna 1 and the antenna 4 are substantially omnidirectional in the whole frequency band for the terrestrial digital television broadcasting.

Figure 15:
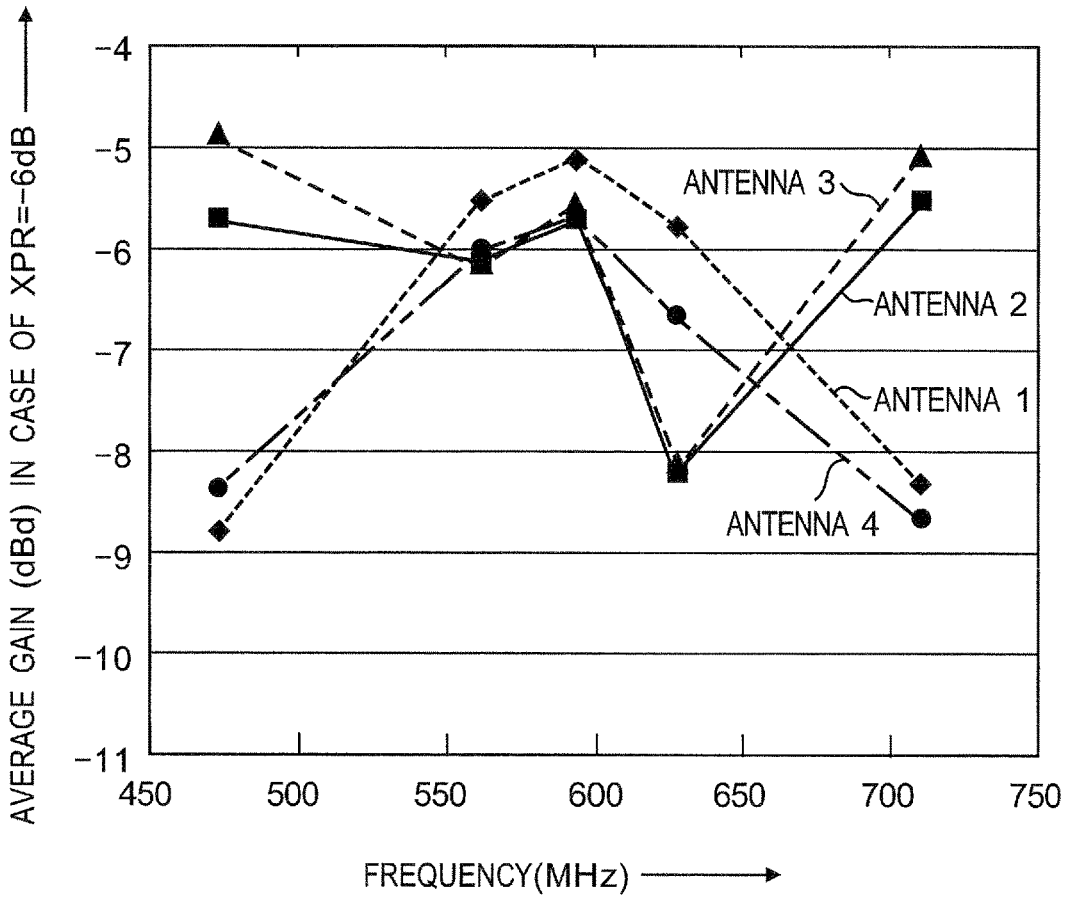
FIG. 15 is a graph showing radiation characteristics of the antennas 1, 2, 3 and 4 of FIG. 2.

FIG. 15 is a graph showing radiation characteristics of the antennas 1, 2, 3 and 4 of FIG. 2. As shown in FIG. 15, an average value of average gains in the frequency band for the terrestrial digital television broadcasting in all-around directions of the antennas 1, 2, 3 and 4 became equal to or greater than −7 dBd.

According to the antenna apparatus of the present embodiment, the antennas 1 and 2 are provided to be adjacent to each other. In this case, the antenna 1 receives the horizontally polarized radio waves, while the antenna 2 receives the vertically polarized radio waves. Therefore, the direction of a ground current flowing in the receiving operation of the antenna 1 and the direction of a ground current flowing in the receiving operation of the antenna 2 are orthogonal to each other. Therefore, the isolation between the antennas 1 and 2 can be obtained to be relatively large. This therefore prevents the occurrences of signal mixing from the other antenna, a decrease in the signal-to-noise ratio at the time of receiving by using the antennas 1 and 2, and a substantial decrease in the gain.

Moreover, the antennas 2 and 3 are provided at the edge portion 102*a* so as to be adjacent to each other, and the antennas 2 and 3 are arranged to be symmetrical with respect to the symmetry line 103 and side by side with respect to the grounding conductor 102, so that the feeding point 24 of the antenna 2 and the feeding point 34 of the antenna 3 are separated apart by a predetermined distance, and therefore, the isolation between the antennas 2 and 3 can be obtained to be relatively large. This therefore prevents the occurrences of signal mixing from the other antenna, a decrease in the signal-to-noise ratio at the time of receiving by using the antennas 2 and 3, and a substantial decrease in the gain.

Further, the antenna 3 receives the vertically polarized radio waves, while the antenna 4 receives the horizontally polarized radio waves. Therefore, the direction of a ground current flowing in the receiving operation of the antenna 3 and the direction of a ground current flowing in the receiving operation of the antenna 4 are orthogonal to each other. Therefore, the isolation between the antennas 3 and 4 can be obtained to be relatively large. This therefore prevents the occurrences of signal mixing from the other antenna, a decrease in the signal-to-noise ratio at the time of receiving by using the antennas 3 and 4, and a substantial decrease in the gain.

According to the present embodiment, since four antennas 1 to 4 can be provided in the vicinities of the grounding conductor 102, the electronic device 100 can be reduced in size further than those of the prior art. Moreover, since the antenna casing for housing the antenna apparatus including the four antennas 1 to 4 needs not be provided in the others than the main body casing of the electronic device 100, it is less expensive and superior in water resistance than those of the prior art.

Although the grounding conductor 102 is used as the grounding conductor for the four antennas 1 to 4 in the present embodiment, the present disclosure is not limited to this. It is acceptable to use the grounding plate of the electronic device 100, such as the shield plate of the electronic device 100 as the grounding conductor for the four antennas 1 to 4. Moreover, although the grounding conductor 102 has a rectangular shape, the present disclosure is not limited to this, and the conductor may have an arbitrary shape.

Moreover, in the present embodiment, the radiating antenna elements 13 and 43 are formed to be substantially parallel to the Y-axis direction. Further, the radiating antenna elements 23 and 33 are formed to be substantially parallel to the X-axis direction substantially perpendicular to the Y-axis direction. However, the present disclosure is not limited to this. The radiating antenna elements 13 and 43 only need to be formed to be substantially parallel to a predetermined first direction, and the antenna elements 23 and 33 only need to be formed to be substantially parallel to a second direction different from the first direction. With this arrangement, the polarization directions of the radio waves received by the mutually adjacent antennas 1 and 2 can be varied, and therefore, the isolation between the antennas 1 and 2 can be secured. Moreover, since the polarization directions of the radio waves received by the mutually adjacent antennas 3 and 4 can be varied, the isolation between the antennas 3 and 4 can be secured. It is noted that the isolation between the antennas 1 and 2 can be maximized, and the isolation between the antennas 3 and 4 can be maximized when the second direction is substantially perpendicular to the first direction.

Modified Embodiment of First Embodiment

Figure 17:
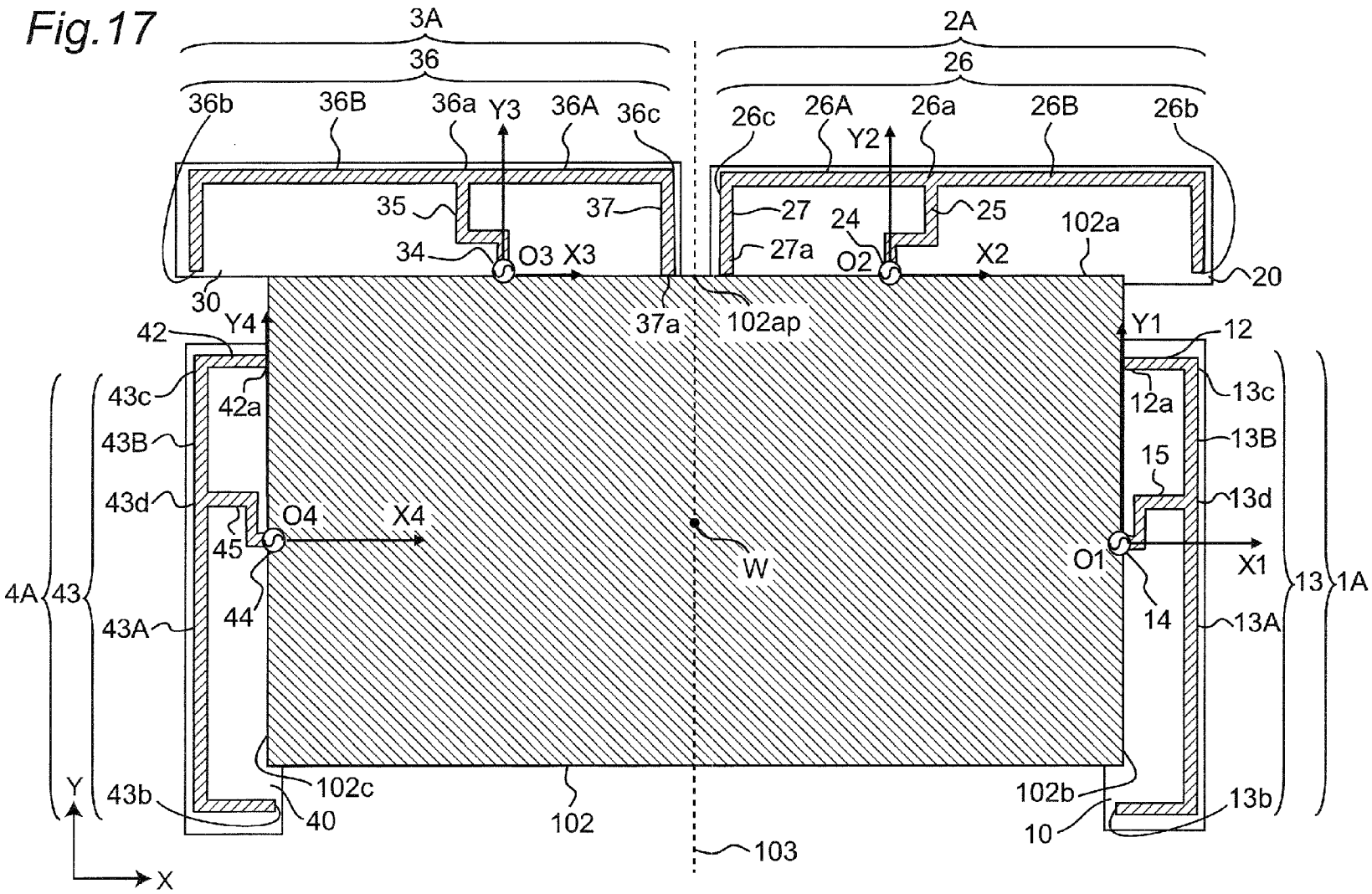
FIG. 17 is a plan view showing an antenna apparatus according to a modified embodiment of the first embodiment of the present disclosure.
Figure 18:
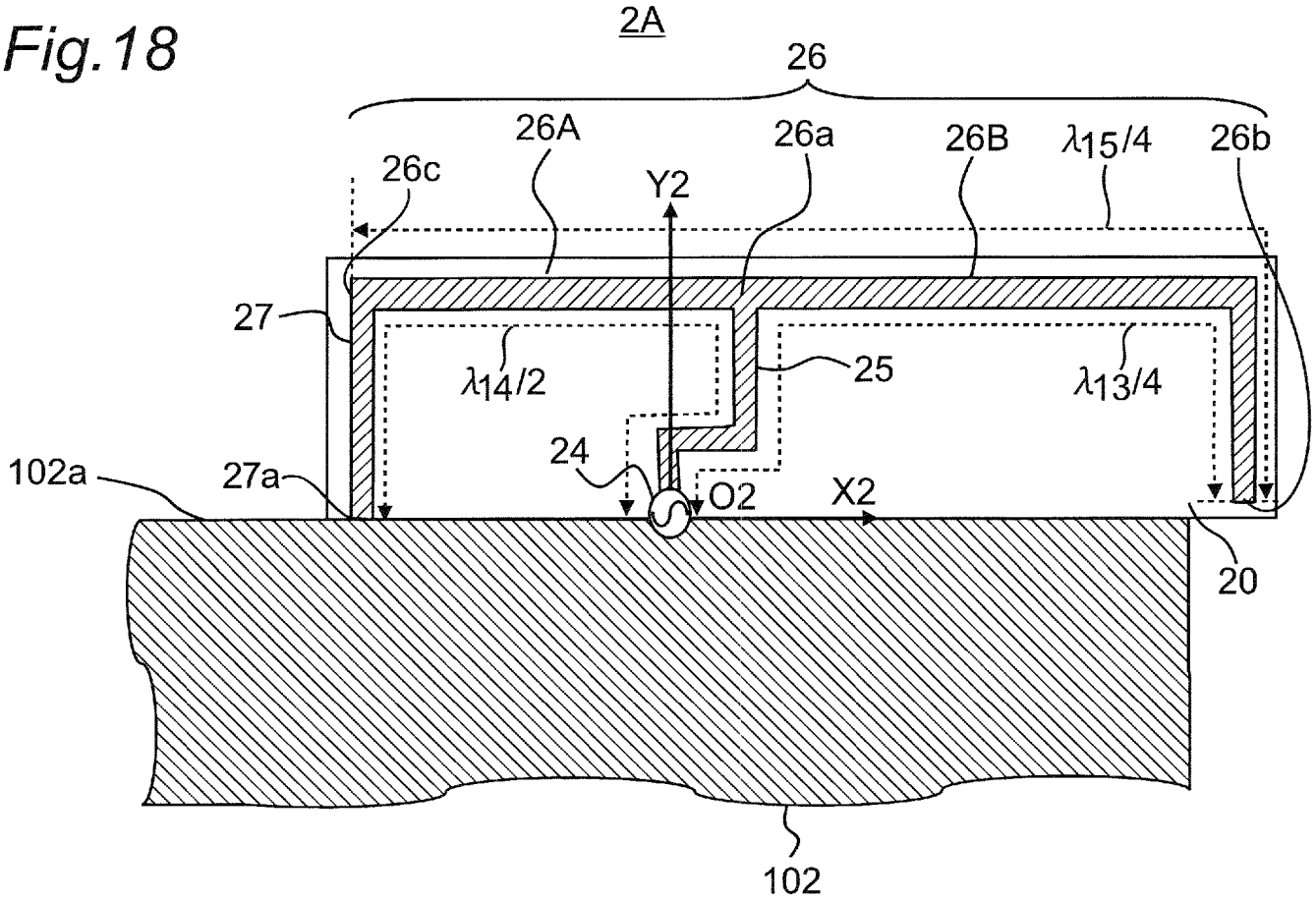
FIG. 18 is a plan view of the antenna 2A of FIG. 17.
Figure 19:
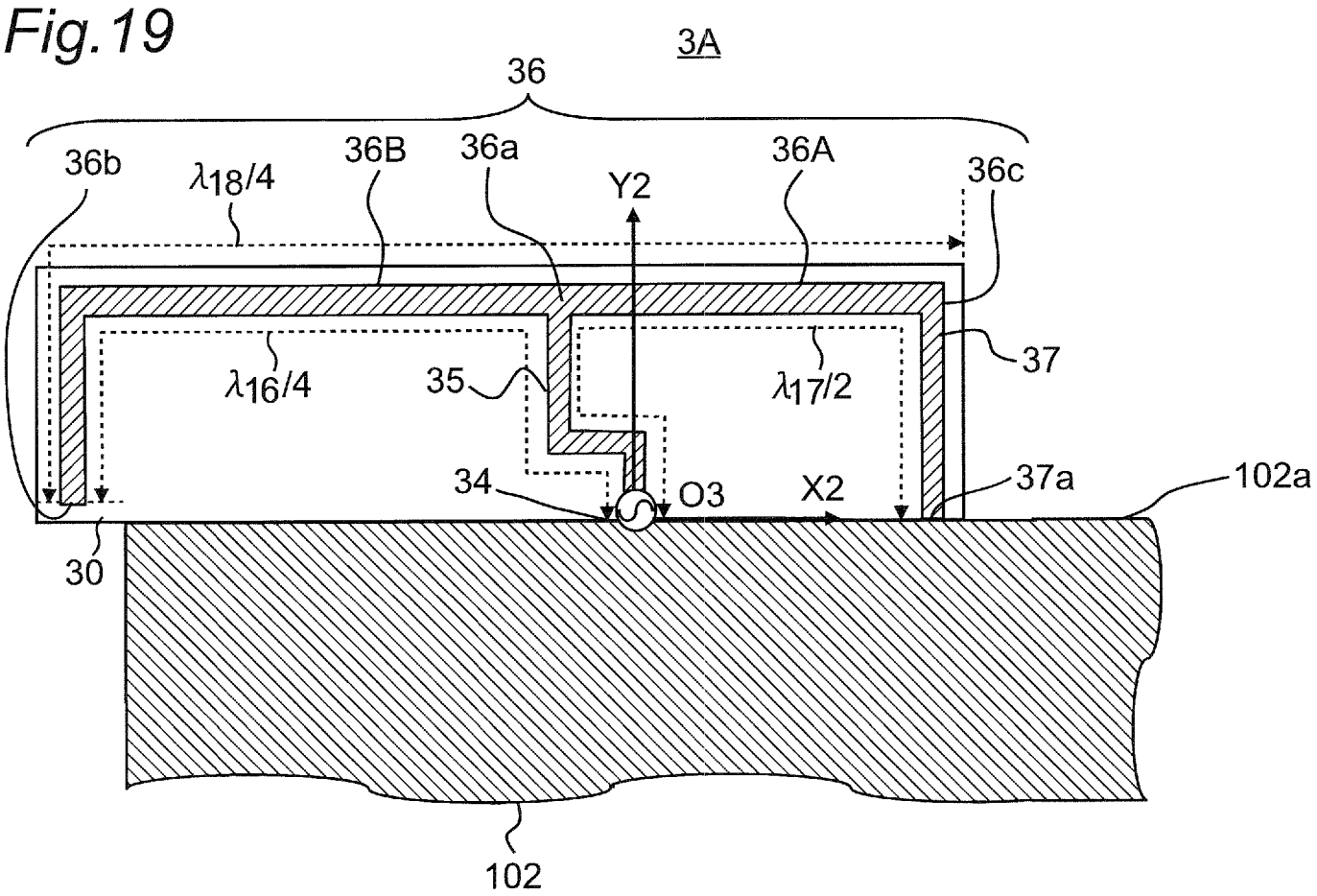
FIG. 19 is a plan view of the antenna 3A of FIG. 17.

FIG. 17 is a plan view showing an antenna apparatus according to a modified embodiment of the first embodiment of the present disclosure. FIG. 18 is a plan view of the antenna 2A of FIG. 17, and FIG. 19 is a plan view of the antenna 3A of FIG. 17. Moreover, in FIGS. 17, 18 and 19, the same components as those of FIGS. 2, 4 and 5 are denoted by same reference numerals, and no description is provided therefor. In FIG. 17, the rightward direction is referred to as an X-axis direction, and the upward direction is referred to as a Y-axis direction. Further, a direction opposite to the X-axis direction is referred to as a −X-axis direction, and a direction opposite to the Y-axis direction is referred to as a −Y1-axis direction. Referring to FIG. 17, the antenna apparatus of the present modified embodiment differs from the antenna apparatus (see FIG. 2) of the first embodiment in that antennas 1A, 2A, 3A and 4A are provided in place of the antennas 1, 2, 3 and 4. Only the points of difference from the first embodiment are described below.

Referring to FIG. 17, the antennas 1A and 4A are provided to be symmetrical with respect to a symmetry line 103 on a grounding conductor 102, and the antennas 2A and 3A are arranged side by side to be symmetrical with respect to the symmetry line 103 so that feeding points 24 and 34 are separated apart by a predetermined distance.

The antenna 1A differs from the antenna 1 in that the antenna 1A includes a feeding antenna element 15 in place of the feeding antenna element 11, and the feeding position to the radiating antenna element 13 is provided shifted further in the Y1-axis direction than the connection point 13*a*. That is, in a case where the Y1-axis direction is referred to as an outward direction, and the −Y1-axis direction is referred to as an inward direction, the feeding position to the radiating antenna element 13 is shifted in the inward direction at the edge portion 102*b* of the grounding conductor 102 by comparison with the first embodiment. One end of the feeding antenna element 15 of the antenna 1A is connected to the feeding point 14, while the feeding antenna element 15 extends from the feeding point 14 in the X1-axis direction, thereafter extends in the Y1-axis direction, further extends in the X1-axis direction, and is thereafter connected to a predetermined connection point 13*d* of the radiating antenna element 13. The antenna 1A configured as described above operates in a manner similar to that of the antenna 1.

The antenna 4A differs from the antenna 4 in that a feeding antenna element 45 is provided in place of the feeding antenna element 41, and the feeding position to the radiating antenna element 43 is provided shifted further in the Y4-axis direction than the connection point 43*a*. That is, when the Y4-axis direction is referred to as an outward direction, and the −Y4-axis direction is referred to as an inward direction, the feeding position to the radiating antenna element 43 is shifted further in the inward direction on the edge portion 102*c* of the grounding conductor 102 by comparison with the first embodiment. One end of the feeding antenna element 45 of the antenna 4A is connected to the feeding point 44. The feeding antenna element 45 extends from the feeding point 44 in the −X4-axis direction, thereafter extends in the Y4-axis direction, further extends in the −X4-axis direction, and is connected to the predetermined connection point 43*d* of the radiating antenna element 43. The antenna 4A configured as described above operates in a manner similar to that of the antenna 4.

Referring to FIG. 18, the antenna 2A is an inverted F antenna, and is configured to include the grounding conductor 102, the feeding antenna element 25, a grounding antenna element 27, the radiating antenna element 26, and the feeding point 24. In this case, the feeding antenna element 25, the grounding antenna element 27 and the radiating antenna element 26 are each made of a conductive foil of copper, silver or the like formed on the dielectric substrate 20. It is noted that no grounding conductor is formed on the back surface of the dielectric substrate 20. Moreover, the feeding position (connection point 26*a*) of the antenna 2A is provided in the outward direction with respect to the symmetry line 103 by comparison with the feeding position (connection point 23*a*) of the antenna 2 of FIG. 2.

Referring to FIG. 18, one end of the feeding antenna element 25 of the antenna 2A is connected to the feeding point 24. The feeding antenna element 25 extends from the feeding point 24 in the Y2-axis direction, thereafter extends in the X2-axis direction, extends in the Y2-axis direction to an edge portion of the dielectric substrate 20, and is thereafter connected to the predetermined connection point 26*a* of the radiating antenna element 26.

Referring to FIG. 18, the radiating antenna element 26 is configured to include element portions 26A and 26B that are connected to each other at the connection point 26*a*. The element portion 26A extends from its one end connected to the connection point 26*a* to its other end 26*c* connected to one end of the grounding antenna element 27 substantially in the −X2-axis direction along an edge portion of the dielectric substrate 20. The element portion 26B is formed to extend from the connection point 26*a* in the X2-axis direction along an edge portion of the dielectric substrate 20, and thereafter extend in the −Y2-axis direction. One end of the element portion 26B is connected to the connection point 26*a*, and another end of the element portion 26B is an open end 26*b*.

Further, the grounding antenna element 27 extends from its one end connected to another end 26*c* of the element portion 26A substantially in the −Y2-axis direction along an edge portion of the dielectric substrate 20, and another end 26*a* of the grounding antenna element 27 is grounded by being connected to the edge portion 102*a*.

As described above, the antenna 2A of the present embodiment is configured to include the grounding antenna element 27 having one end 27*a* connected to the grounding conductor 102, the radiating antenna element 26 that is formed to be substantially parallel to the edge portion 102*a* of the grounding conductor 102 and has one end 26*c* connected to another end of the grounding antenna element 27, and the open end 26*b*, and the feeding antenna element 25 configured to connect the feeding point 24 with the connection point 26*a* on the radiating antenna element 26.

The antenna 2A configured as described above includes thirteenth to fifteenth radiating elements. In this case, the thirteenth radiating element is a monopole antenna configured to include a radiating antenna element that includes a portion extending from the feeding point 24 to the open end 26*b* of the radiating antenna element 26 via the feeding antenna element 25, the connection point 26*a*, and the element portion 26B. The electrical length of the thirteenth radiating element is set to $\lambda_{13}/4$ that is a quarter of wavelength $\lambda_{13}$, and the thirteenth radiating element resonates at a resonance frequency f13 corresponding to the wavelength λ13 and is able to receive a wireless signal having a radio frequency of the resonance frequency f13. Moreover, the fourteenth radiating element is a loop antenna configured to include a radiating antenna element that includes a portion extending from the feeding point 24 to another end 27*a* of the grounding antenna element 27 via the feeding antenna element 25, the element portion 26A, and the grounding antenna element 27. The electrical length of the fourteenth radiating element is set to $\lambda_{14}/2$ that is a half of wavelength $\lambda_{14}$, and the fourteenth radiating element resonates at a resonance frequency f14 corresponding to the wavelength $\lambda_{14}$ and is able to receive a wireless signal having a radio frequency of the resonance frequency f14.

Further, referring to FIG. 18, the fifteenth radiating element is a conductor-loaded monopole antenna configured to include a radiating antenna element that includes a portion extending from the open end 26*b* of the radiating antenna element 26 to another end 26*c* of radiating antenna element 26 via the element portions 26B and 26A. The fifteenth radiating element is fed with electric power for excitation at the connection point 26*a* with the feeding antenna element 25 used as a feeding line. Moreover, the electrical length of the fifteenth radiating element is set to $\lambda_{15}/4$ that is a quarter of wavelength $\lambda$15, and the fifteenth radiating element resonates at a resonance frequency f15 corresponding to the wavelength $\lambda$15 and is able to receive a wireless signal having a radio frequency of the resonance frequency f15.

The antenna 2A configured as described above receives vertically polarized radio waves having a polarization direction parallel to the Y2-axis direction. When the radio waves are received by the antenna 2A, a received signal received by the antenna 2A is outputted to the wireless communication circuit 104 via the feeding point 24 and a feeder cable.

Referring to FIG. 19, the antenna 3A is an inverted F antenna, and is configured to include the grounding conductor 102, a feeding antenna element 35, a grounding antenna element 37, a radiating antenna element 36, and a feeding point 34. In this case, the feeding antenna element 35, the grounding antenna element 37 and the radiating antenna element 36 are each made of a conductive foil of copper, silver or the like formed on a dielectric substrate 30. It is noted that no grounding conductor is formed on the back surface of the dielectric substrate 30. Moreover, the feeding position (connection point 36*a*) of the antenna 3A is provided shifted in the outward direction with respect to the symmetry line 103 by comparison with the feeding position (connection point 33*a*) of the antenna 3 of FIG. 2.

One end of the feeding antenna element 35 is connected to the feeding point 34. The feeding antenna element 35 extends from the feeding point 34 in the Y3-axis direction, extends in the −X3-axis direction, extends in the Y3-axis direction to an edge portion of the dielectric substrate 30, and is thereafter connected to the predetermined connection point 36*a* of the radiating antenna element 36.

Referring to FIG. 19, the radiating antenna element 36 is configured to include element portions 36A and 36B that are connected to each other at the connection point 36*a*. Moreover, one end of the element portion 36B is connected to the connection point 36*a*, and another end of the element portion 36B is an open end 36*b*. The element portion 36B is formed to extend from the connection point 36*a* substantially in the −X3-axis direction along an edge portion of the dielectric substrate 30, and thereafter extend in the −Y3-axis direction. Moreover, the element portion 36A extends from its one end connected to the connection point 36*a* to its other end 36*c* connected to one end of the grounding antenna element 37 substantially in the X3-axis direction along an edge portion of the dielectric substrate 30.

Further, referring to FIG. 19, the grounding antenna element 37 extends from its one end connected to another end 36*c* of the element portion 36B substantially in the −Y3-axis direction along an edge portion of the dielectric substrate 30, and another end 37*a* of the grounding antenna element 37 is grounded by being connected to the edge portion 102*a*.

As described above, the antenna 3A is configured to include the grounding antenna element 37 having one end 37*a* connected to the grounding conductor 102, the radiating antenna element 36 that is formed to be substantially parallel to the edge portion 102*a* of the grounding conductor 102 and has one end 36*c* connected to another end of the grounding antenna element 37, and the open end 36*b*, and the feeding antenna element 35 configured to connect the feeding point 34 with the connection point 36*a* on the radiating antenna element 36.

The antenna 3A configured as described above includes sixteenth to eighteenth radiating elements. In this case, as shown in FIG. 19, the sixteenth radiating element is a monopole antenna configured to include a radiating antenna element that includes a portion extending from the feeding point 34 to the open end 36*b* of the radiating antenna element 36 via the feeding antenna element 35, the connection point 36*a*, and the element portion 36B. The electrical length of the sixteenth radiating element is set to $\lambda_{16}/4$ that is a quarter of wavelength $\lambda_{16}$, and the sixteenth radiating element resonates at a resonance frequency f16 corresponding to the wavelength $\lambda_{16}$ and is able to receive a wireless signal having a radio frequency of the resonance frequency f16. Moreover, the seventeenth radiating element is a loop antenna configured to include a radiating antenna element that includes a portion extending from the feeding point 34 to another end 37*a* of the grounding antenna element 37 via the feeding antenna element 35, the element portion 36A, and the grounding antenna element 37. The electrical length of the seventeenth radiating element is set to $\lambda_{17}/2$ that is a half of wavelength $\lambda_{17}$, and the seventeenth radiating element resonates at a resonance frequency f17 corresponding to the wavelength $\lambda_{17}$ and is able to receive a wireless signal having a radio frequency of the resonance frequency f17.

Further, referring to FIG. 19, the eighteenth radiating element is a conductor-loaded monopole antenna configured to include a radiating antenna element that includes a portion extending from the open end 36*b* of the radiating antenna element 36 to another end 36*c* of the radiating antenna element 36 via the element portions 36B and 36A. The eighteenth radiating element is fed with electric power for excitation at the connection point 36*a* with the feeding antenna element 35 used as a feeding line. Moreover, the electrical length of the eighteenth radiating element is set to $\lambda_{18}/4$ that is a quarter of wavelength $\lambda_{18}$, and the eighteenth radiating element resonates at a resonance frequency f18 corresponding to the wavelength $\lambda_{18}$ and is able to receive a wireless signal having a radio frequency of the resonance frequency f18.

The antenna 3A configured as described above receives vertically polarized radio waves having a polarization direction parallel to the Y3-axis direction. When the radio waves are received by the antenna 3A, a received signal received by the antenna 3A is outputted to the wireless communication circuit 104 via the feeding point 34 and a feeder cable.

Figure 20:
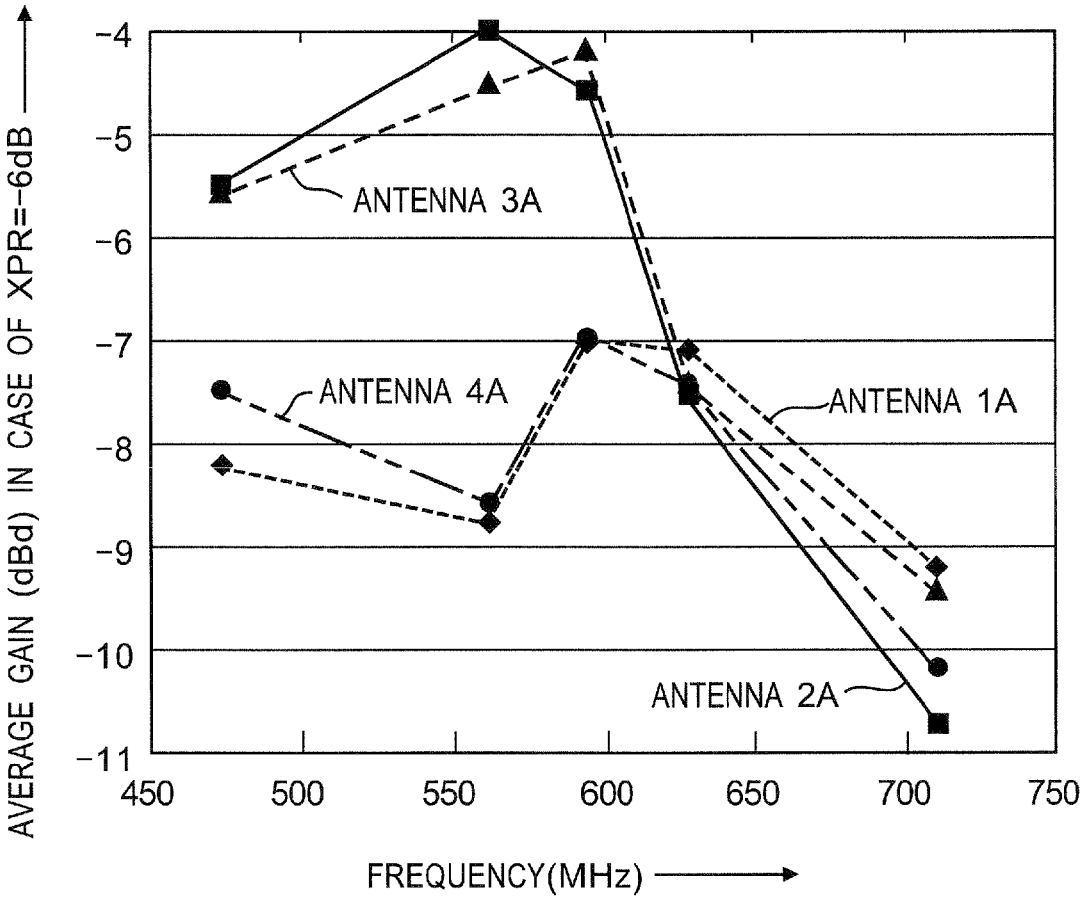
FIG. 20 is a graph showing radiation characteristics of the antennas 1A, 2A, 3A and 4A of FIG. 17.

FIG. 20 is a graph showing radiation characteristics of the antennas 1A, 2A, 3A and 4A of FIG. 17. As shown in FIG. 20, an average value of average gains in the frequency band for the terrestrial digital television broadcasting in all-around directions of the antennas 1A, 2A, 3A and 4A became equal to or greater than −7 dBd.

According to the antenna apparatus of the present modified embodiment, the antennas 1A and 2A are provided to be adjacent to each other. In this case, the antenna 1A receives the horizontally polarized radio waves, while the antenna 2A receives the vertically polarized radio waves. Therefore, the direction of a ground current flowing in the receiving operation of the antenna 1A and the direction of a ground current flowing in the receiving operation of the antenna 2A are orthogonal to each other. Therefore, the isolation between the antennas 1A and 2A can be obtained to be relatively large. This therefore prevents the occurrences of signal mixing from the other antenna, a decrease in the signal-to-noise ratio at the time of receiving by using the antennas 1A and 2A, and a substantial decrease in the gain.

Moreover, the antennas 2A and 3A, which are provided at the edge portion 102*a* to be adjacent to each other, are arranged side by side so that the feeding point 24 of the antenna 2A and the feeding point 34 of the antenna 3A are separated apart by a predetermined distance, and therefore, the isolation between the antennas 2A and 3A can be obtained to be relatively large. This therefore prevents the occurrences of signal mixing from the other antenna, a decrease in the signal-to-noise ratio at the time of receiving by using the antennas 2 and 3, and a substantial decrease in the gain.

Further, the antenna 3A receives the vertically polarized radio waves, while the antenna 4A receives the horizontally polarized radio waves. Therefore, the direction of a ground current flowing in the receiving operation of the antenna 3A and the direction of a ground current flowing in the receiving operation of the antenna 4A are orthogonal to each other. Therefore, the isolation between the antennas 3A and 4A can be obtained to be relatively large. This therefore prevents the occurrences of signal mixing from the other antenna, a decrease in the signal-to-noise ratio at the time of receiving by using the antennas 3A and 4A, and a substantial decrease in the gain.

According to the present modified embodiment, since the four antennas 1A to 4A can be provided in the vicinities of the grounding conductor 102, the electronic device 100 can be reduced in size further than those of the prior art. Moreover, since the antenna casing for housing the antenna apparatus including the four antennas 1A to 4A needs not be provided in the others than the main body casing of the electronic device 100, it is less expensive and superior in water resistance than those of the prior art.

Although the grounding conductor 102 is used as a grounding conductor for the four antennas 1A to 4A in the present embodiment, the present disclosure is not limited to this. It is acceptable to use the grounding plate of the electronic device 100, such as the shield plate of the electronic device 100 as the grounding conductor for the four antennas 1A to 4A. Moreover, although the grounding conductor 102 has a rectangular shape, the present disclosure is not limited to this, and the conductor may have an arbitrary shape.

Moreover, in the present embodiment, the radiating antenna elements 13 and 43 are formed to be substantially parallel to the Y-axis direction. Further, the radiating antenna elements 26 and 36 are formed to be substantially parallel to the X-axis direction substantially perpendicular to the Y-axis direction. However, the present disclosure is not limited to this. The radiating antenna elements 13 and 43 only need to be formed to be substantially parallel to a predetermined first direction, and the antenna elements 26 and 36 only need to be formed to be substantially parallel to a second direction different from the first direction. With this arrangement, the polarization directions of the radio waves received by the mutually adjacent antennas 1A and 2A can be varied, and therefore, the isolation between the antennas 1A and 2A can be secured. Moreover, since the polarization directions of the radio waves received by the mutually adjacent antennas 3A and 4A can be varied, the isolation between the antennas 3A and 4A can be secured. It is noted that the isolation between the antennas 1A and 2A can be maximized, and the isolation between the antennas 3A and 4A can be maximized when the second direction is substantially perpendicular to the first direction.

Second Embodiment

Figure 21:
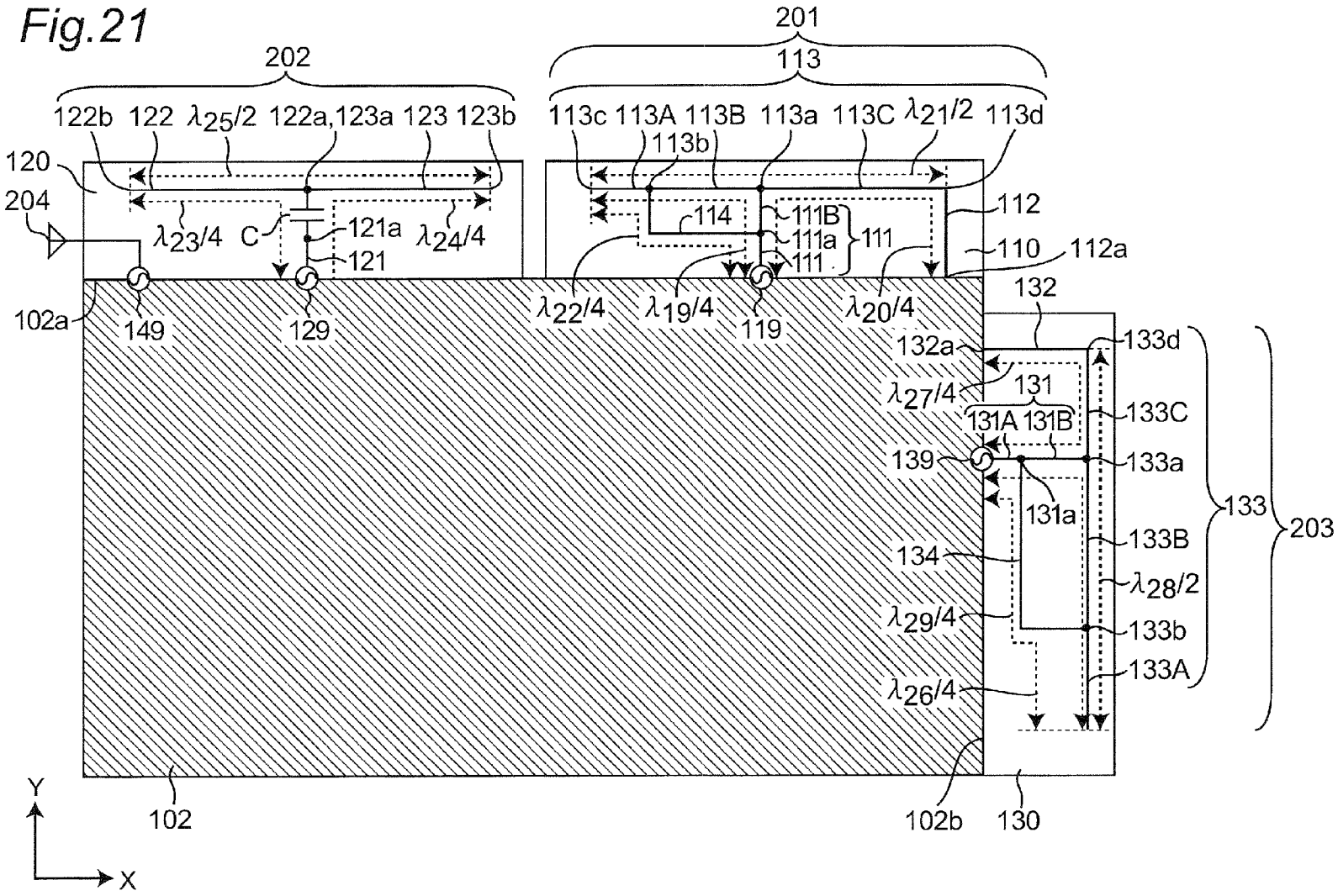
FIG. 21 is a plan view of an antenna apparatus according to a second embodiment of the present disclosure.

FIG. 21 is a plan view of an antenna apparatus according to the second embodiment of the present disclosure. The antenna apparatus of the present embodiment differs from the antenna apparatus of the first embodiment in that antennas 201, 202, 203 and 204 are provided in place of the antennas 1, 2, 3 and 4. Only the points of difference from the first embodiments are described below. It is noted that the rightward direction of FIG. 21 is referred to as an X-axis direction, and the upward direction is referred to as a Y-axis direction. Further, a direction opposite to the X-axis direction is referred to as a −X1-axis direction, and a direction opposite to the Y-axis direction is referred to as a −Y-axis direction.

Referring to FIG. 21, dielectric substrates 110, 120 and 130 are, for example, printed wiring boards, and are each fixed in an identical plane parallel to the surface of the grounding conductor 102. The antenna 201 is provided in the right half region of an edge portion 102*a*, the antenna 202 is provided in the left half region of the edge portion 102*a*, and the antenna 203 is provided at an edge portion 102*b*.

Referring to FIG. 21, the antenna 204 is a monopole antenna, and is configured to include a radiating antenna element, and a feeding point 149 provided at a left end portion of the edge portion 102*a*. The radiating antenna element of the antenna 204 extends in a direction (leftward direction of FIG. 21) substantially parallel to the edge portion 102*a* so as to protrude from the electronic device 100. The electrical length of the radiating antenna element is set to $\lambda_m/4$ that is a quarter of wavelength $\lambda_m$, and horizontally polarized radio waves having a predetermined frequency $f_m$ corresponding to the wavelength $\lambda_m$ is received. When the radio waves are received by the antenna 204, a received signal received by the antenna 204 is outputted to a wireless communication circuit 104 via the feeding point 149 and a feeder cable. Moreover, a ground current generated in accordance with the receiving operation of the antenna 204 flows in the grounding conductor 102.

Referring to FIG. 21, the antenna 201 is an inverted F antenna, and is configured to include the grounding conductor 102, a feeding antenna element 111, a grounding antenna element 112, radiating antenna elements 113 and 114, and a feeding point 119 provided at an edge portion 102*a*. In this case, the feeding antenna element 111, the grounding antenna element 112 and the radiating antenna elements 113 and 114 are each made of a conductive foil of copper, silver or the like formed on a dielectric substrate 110. It is noted that no grounding conductor is formed on the back surface of the dielectric substrate 110.

Referring to FIG. 21, the feeding antenna element 111 is configured to include element portions 111A and 111B that are connected to each other at a connection point 111*a*. One end of the element portion 111A is connected to the feeding point 119, thereafter extends in the Y-axis direction from the feeding point 119, and is connected to the connection point 111*a*. Moreover, the element portion 111B extends in the Y-axis direction from the connection point 111*a* to an edge portion of the dielectric substrate 110, and is thereafter connected to a predetermined connection point 113*a* of the radiating antenna element 113. The radiating antenna element 114 extends in the −X-axis direction from the connection point 111*a*, thereafter extends in the Y-axis direction to an edge portion of the dielectric substrate 110, and is connected to a predetermined connection point 113*b* of the radiating antenna element 113.

Moreover, referring to FIG. 21, the radiating antenna element 113 is configured to include element portions 113A, 113B and 113C. In this case, the element portions 113A and 113B are connected to each other at the connection point 113*b*, while the element portions 113B and 113C are connected to each other at the connection point 113*a*. The element portion 113B is formed to be substantially parallel to the −X-axis direction along an edge portion of the dielectric substrate 110 from the connection point 113*a* to the connection point 113*b*.

Moreover, referring to FIG. 21, one end of the element portion 113A is connected to the connection point 113*b*, and another end of the element portion 113A is an open end 113*c*. In this case, the element portion 113A extends from the connection point 113*b* substantially in the −X-axis direction along an edge portion of the dielectric substrate 110. Further, the element portion 113C extends from its one end connected to the connection point 113*a* to another end 113*d* connected to one end of the grounding antenna element 112 substantially in the X-axis direction along an edge portion of the dielectric substrate 110. Further, referring to FIG. 21, the grounding antenna element 112 extends from its one end connected to another end 113*d* of the element portion 113C substantially in the −Y-axis direction along an edge portion of the dielectric substrate 10, and another end 112*a* of the grounding antenna element 112 is grounded by being connected to the edge portion 102*a*.

As described above, the antenna 201 is configured to include the grounding antenna element 112 having one end 112*a* connected to the grounding conductor 102, the radiating antenna element 113 that is formed to be substantially parallel to the edge portion 102*a* of the grounding conductor 102 and has one end 113*d* connected to another end of the grounding antenna element 112, the feeding antenna element 111 configured to connect the feeding point 119 with the connection point 113*a* on the radiating antenna element 113, and the radiating antenna element 114 configured to connect the connection point 111*a* on the feeding antenna element 111 with the connection point 113*b* on the radiating antenna element 113.

The antenna 201 configured as described above includes nineteenth to twenty-second radiating elements. In this case, as shown in FIG. 21, the nineteenth radiating element is a monopole antenna configured to include a radiating antenna element that includes a portion extending from the feeding point 119 to the open end 113*c* of the radiating antenna element 113 via the feeding antenna element 111, the element portion 113B, and the element portion 113A. The electrical length of the nineteenth radiating element is set to $\lambda_{19}/4$ that is a quarter of wavelength $\lambda_{19}$, and the nineteenth radiating element resonates at a resonance frequency f19 corresponding to the wavelength $\lambda_{19}$ and is able to receive a wireless signal having a radio frequency of the resonance frequency f19. Moreover, the twentieth radiating element is a loop antenna configured to include a radiating antenna element that includes a portion extending from the feeding point 119 to another end 112*a* of the grounding antenna element 112 via the feeding antenna element 111, the element portion 113C, and the grounding antenna element 112. The electrical length of the twentieth radiating element is set to $\lambda_{20}/4$ that is a quarter of wavelength $\lambda_{20}$, and the twentieth radiating element resonates at a resonance frequency f20 corresponding to the wavelength $\lambda_{20}$ and is able to receive a wireless signal having a radio frequency of the resonance frequency f20.

Further, referring to FIG. 21, the twenty-first radiating element is a conductor-loaded monopole antenna configured to include a radiating antenna element that includes a portion extending from the open end 113*c* of the radiating antenna element 113 to another end 113*d* of the radiating antenna element 113 via the element portions 113A, 113B and 113C. The twenty-first radiating element is fed with electric power for excitation at the connection point 113*a* with the feeding antenna element 111 used as a feeding line. Moreover, the electrical length of the twenty-first radiating element is set to $\lambda_{21}/2$ that is a half of wavelength $\lambda_{21}$, and the twenty-first radiating element resonates at a resonance frequency f21 corresponding to the wavelength $\lambda_{21}$ and is able to receive a wireless signal having a radio frequency of the resonance frequency f21. Moreover, the twenty-second radiating element is a monopole antenna configured to include a radiating antenna element that includes a portion extending from the feeding point 119 to the open end 113*c* of the radiating antenna element 113 via the element portion 111A, the radiating antenna element 114, and the element portion 113A. The electrical length of the twenty-second radiating element is set to $\lambda_{22}/4$ that is a quarter of wavelength $\lambda_{22}$, and the twenty-second radiating element resonates at a resonance frequency f22 corresponding to the wavelength $\lambda_{22}$ and is able to receive a wireless signal having a radio frequency of the resonance frequency f22.

The antenna 201 configured as described above receives vertically polarized radio waves having a polarization direction parallel to the Y-axis direction. When the radio waves are received by the antenna 201, a received signal received by the antenna 201 is outputted to a wireless communication circuit 104 via the feeding point 119 and a feeder cable. Moreover, a ground current generated in accordance with the receiving operation of the antenna 201 flows in the grounding conductor 102. Moreover, since the radiating antenna element 114 is provided, the wireless signal having the resonance frequency f22 can be received in addition to the wireless signals having the resonance frequencies f19, f20 and f21.

Referring to FIG. 21, the antenna 202 is a T type antenna, and is configured to include the grounding conductor 102, a feeding antenna element 121, radiating antenna elements 122 and 123, a coupling capacitance C, and a feeding point 129 provided at the edge portion 102*a*. In this case, the feeding antenna element 121 and the radiating antenna elements 122 and 123 are each made of a conductive foil of copper, silver or the like formed on a dielectric substrate 120. It is noted that no grounding conductor is formed on the back surface of the dielectric substrate 120.

Referring to FIG. 21, one end of the feeding antenna element 121 is connected to the feeding point 129, and the feeding antenna element 121 extends in the Y-axis direction from the feeding point 129. An open end 121*a* that is another end of the feeding antenna element 121 is formed to be adjacent so as to be capacitively coupled to a connection point of one end 122*a* of the radiating antenna element 122 and one end 123*a* of the radiating antenna element 123. In this case, the coupling capacitance C is generated between the open end 121*a* of the feeding antenna element 121 and a connection point between one ends 122*a* and 123*b* of the radiating antenna elements 122 and 123. Moreover, the radiating antenna element 122 is formed to be substantially parallel to the −X-axis direction along an edge portion of the dielectric substrate 120 from the one end 122*a* to the open end 122*b*. Further, the radiating antenna element 123 is formed to be substantially parallel to the X-axis direction along an edge portion of the dielectric substrate 120 from the one end 123*a* to the open end 123*b*.

As described above, the antenna 202 is configured to include the feeding antenna element 121 having one end connected to the feeding point 129, and the radiating antenna elements 122 and 123 formed to be substantially parallel to the edge portion 102*a* of the grounding conductor 102. In this case, the open end 121*a* that is another end of the feeding antenna element 121 is formed to generate the coupling capacitance C between the open end 121*a* and the connection point of one ends 122*a* and 123*b* of the radiating antenna elements 122 and 123.

The antenna 202 configured as described above includes twenty-third to twenty-fifth radiating elements. In this case, as shown in FIG. 21, the twenty-third radiating element is a monopole antenna configured to include a radiating antenna element that includes a portion extending from the feeding point 129 to the open end 122*b* of the radiating antenna element 122 via the feeding antenna element 121, the coupling capacitance C, and the radiating antenna element 122. The electrical length of the twenty-third radiating element is set to $(\alpha+\lambda_{23}/4)$ that is longer than a quarter of wavelength $\lambda_{23}$, and the twenty-third radiating element resonates at a resonance frequency f23 corresponding to the wavelength $\lambda_{23}$ and is able to receive a wireless signal having a radio frequency of the resonance frequency f23. It is noted that the electrical length $\alpha$ is set to an electrical length of, for example, $\lambda_{23}/20$ to $\lambda_{23}/10$.

Moreover, the twenty-fourth radiating element is a monopole antenna configured to include a radiating antenna element that includes a portion extending from the feeding point 129 to the open end 123*b* of the radiating antenna element 123 via the feeding antenna element 121, the coupling capacitance C, and the radiating antenna element 123. The electrical length of the twenty-fourth radiating element is set to $(\beta+\lambda_{24}/4)$ that is longer than a quarter of wavelength $\lambda_{24}$, and the twenty-fourth radiating element resonates at a resonance frequency f24 corresponding to the wavelength $\lambda_{24}$ and is able to receive a wireless signal having a radio frequency of the resonance frequency f24. It is noted that the electrical length 13 is set to an electrical length of, for example, $\lambda_{24}/20$ to $\lambda_{24}/10$.

Further, referring to FIG. 21, the twenty-fifth radiating element is a conductor-loaded monopole antenna configured to include a radiating antenna element that includes a portion extending from the open end 122*b* of the radiating antenna element 122 to the open end 123*b* of the radiating antenna element 123 via the radiating antenna element 122, the one ends 122*a* and 123*a* of the radiating antenna elements 122 and 123, and the radiating antenna element 123. The twenty-fifth radiating element is fed with electric power for excitation at the connection point of the one ends 122*a* and 123*b* of the radiating antenna elements 122 and 123 with the feeding antenna element 121 and the coupling capacitance C used as a feeding line. Moreover, the electrical length of the twenty-fifth radiating element is set to $\lambda_{25}/2$ that is a half of wavelength $\lambda_{25}$, and the twenty-fifth radiating element resonates at a resonance frequency f25 corresponding to the wavelength $\lambda_{25}$ and is able to receive a wireless signal having a radio frequency of the resonance frequency f25.

The antenna 202 configured as described above receives vertically polarized radio waves having a polarization direction parallel to the Y-axis direction. When the radio waves are received by the antenna 202, a received signal received by the antenna 202 is outputted to the wireless communication circuit 104 via the feeding point 129 and a feeder cable. At this time, no ground current flows in the grounding conductor 102 in accordance with the receiving operation of the twenty-fifth radiating element. Moreover, since the electrical length of the twenty-third radiating element is set to $(\alpha+\lambda_{23}/4)$ that is longer than a quarter of wavelength $\lambda_{23}$, the quantity of ground current flowing in the grounding conductor 102 in accordance with the receiving operation of the twenty-third radiating element can be reduced by comparison with a case where the electrical length of the twenty-third radiating element is set to $\lambda_{23}/4$ that is a quarter of wavelength $\lambda_{23}$. Further, since the electrical length of the twenty-fourth radiating element is set to $(\alpha+\lambda_{24}/4)$ that is longer than a quarter of wavelength $\lambda_{24}$, the quantity of ground current flowing in the grounding conductor 102 in accordance with the receiving operation of the twenty-fourth radiating element can be reduced by comparison with a case where the electrical length of the twenty-fourth radiating element is set to $\lambda_{24}/4$ that is a quarter of wavelength $\lambda_{24}$.

Further, the phase of the radiation waves excited at the receiving time of the antenna 202 shifts from the phases of the radiation waves excited at the receiving time of the other antennas 201, 203 and 204 due to the coupling capacitance C. Therefore, the antenna 202 and the other antennas 201, 203 and 204 can be prevented from being electromagnetically coupled to each other.

Referring to FIG. 21, the antenna 203 is an inverted F antenna, and is configured to include the grounding conductor 102, a feeding antenna element 131, a grounding antenna element 132, radiating antenna elements 133 and 134, and a feeding point 139 provided at the edge portion 102*b*. In this case, the radiating antenna elements 131 to 137 are each made of a conductive foil of copper, silver or the like formed on the dielectric substrate 130. It is noted that no grounding conductor is formed on the back surface of the dielectric substrate 130.

Referring to FIG. 21, the radiating antenna element 131 is configured to include element portions 131A and 131B that are connected to each other at a connection point 131*a*. One end of the element portion 131A is connected to the feeding point 139. The element portion 131A extends in the X-axis direction from the feeding point 139, and another end of the element portion 131A is connected to the connection point 131*a*. Moreover, the element portion 131B extends in the X-axis direction from the connection point 131*a* to an edge portion of the dielectric substrate 110, and is thereafter connected to a predetermined connection point 133*a* of the radiating antenna element 133. The radiating antenna element 134 extends substantially in the −Y-axis direction from the connection point 131*a*, and is thereafter connected to a predetermined connection point 133*b* of the radiating antenna element 133.

Moreover, referring to FIG. 21, the radiating antenna element 133 is configured to include element portions 133A, 133B and 133C. In this case, the element portions 133A and 133B are connected to each other at the connection point 133*b*, while the element portions 133B and 113C are connected to each other at the connection point 133*a*. The element portion 133B is formed to be substantially parallel to the −Y-axis direction along an edge portion of the dielectric substrate 110 from the connection point 133*a* to the connection point 133*b*.

Moreover, referring to FIG. 21, one end of the element portion 133A is connected to the connection point 133*b*, and another end of the element portion 133A is an open end 133*c*. In this case, the element portion 133A extends from the connection point 133*b* in the −X-axis direction along an edge portion of the dielectric substrate 110. Further, the element portion 133C extends from its one end connected to the connection point 133*a* to another end 133*d* connected to one end of the grounding antenna element 132 substantially in the Y-axis direction along an edge portion of the dielectric substrate 110. Further, referring to FIG. 21, the grounding antenna element 132 extends from its one end connected to another end 133*d* of the radiating antenna element 133 in the −X-axis direction along an edge portion of the dielectric substrate 110, and another end 132*a* of the grounding antenna element 132 is grounded by being connected to the edge portion 102*b*.

As described above, the antenna 203 is configured to include the grounding antenna element 132 having one end 132*a* connected to the grounding conductor 102, the radiating antenna element 133 that is formed to be substantially parallel to the edge portion 102*b* of the grounding conductor 102 and has one end connected to another end of the grounding antenna element 132, the feeding antenna element 131 configured to connect the feeding point 139 with the connection point 133*a* on the radiating antenna element 133, and the radiating antenna element 134 configured to connect the connection point 131*a* on the feeding antenna element 131 with the connection point 133*b* on the radiating antenna element 133.

The antenna 203 configured as described above includes twenty-seventh to thirtieth radiating elements. In this case, as shown in FIG. 21, the twenty-seventh radiating element is a monopole antenna configured to include a radiating antenna element that includes a portion extending from the feeding point 139 to the open end 133*c* of the radiating antenna element 133 via the feeding antenna element 131, the element portion 133B, and the element portion 133A. The electrical length of the twenty-seventh radiating element is set to $\lambda_{27}/4$ that is a quarter of wavelength $\lambda_{27}$, and the twenty-seventh radiating element resonates at a resonance frequency f27 corresponding to the wavelength $\lambda_{27}$ and is able to receive a wireless signal having a radio frequency of the resonance frequency f27. Moreover, the twenty-eighth radiating element is a monopole antenna configured to include a radiating antenna element that includes a portion extending from the feeding point 139 to another end 132*a* of the grounding antenna element 132 via the feeding antenna element 131, the element portion 133C, and the grounding antenna element 132. The electrical length of the twenty-eighth radiating element is set to $\lambda_{28}/4$ that is a quarter of wavelength $\lambda_{28}$, and the twenty-eighth radiating element resonates at a resonance frequency f28 corresponding to the wavelength $\lambda_{28}$ and is able to receive a wireless signal having a radio frequency of the resonance frequency f28.

Further, referring to FIG. 21, the twenty-ninth radiating element is a conductor-loaded monopole antenna configured to include a radiating antenna element that includes a portion extending from the open end 113*c* of the radiating antenna element 133 to another end 133*d* of the radiating antenna element 133 via the element portions 133A, 133B and 133C. The twenty-ninth radiating element is fed with electric power for excitation at the connection point 133*a* with the feeding antenna element 131 used as a feeding line. Moreover, the electrical length of the twenty-ninth radiating element is set to $\lambda_{29}/2$ that is a half of wavelength $\lambda_{29}$, and the twenty-ninth radiating element resonates at a resonance frequency f29 corresponding to the wavelength $\lambda_{29}$ and is able to receive a wireless signal having a radio frequency of the resonance frequency f29. Moreover, the thirtieth radiating element is a monopole antenna configured to include a radiating antenna element that includes a portion extending from the feeding point 139 to the open end 133*c* of the radiating antenna element 133 via the element portion 131A, the radiating antenna element 134, and the element portion 133A. The electrical length of the thirtieth radiating element is set to $\lambda_{30}/4$ that is a quarter of wavelength $\lambda_{30}$, and the thirtieth radiating element resonates at a resonance frequency f30 corresponding to the wavelength $\lambda_{30}$ and is able to receive a wireless signal having a radio frequency of the resonance frequency f30.

The antenna 203 configured as described above receives horizontally polarized radio waves having a polarization direction parallel to the X-axis direction. When the radio waves are received by the antenna 203, a received signal received by the antenna 203 is outputted to the wireless communication circuit 104 via the feeding point 139 and a feeder cable. Moreover, a ground current generated in accordance with the receiving operation of the antenna 203 flows in the grounding conductor 102. Moreover, since the radiating antenna element 134 is provided, a wireless signal having the resonance frequency f30 can be received in addition to wireless signals having the resonance frequencies f27, f28 and f29.

According to the antenna apparatus of the present embodiment, the antennas 201 and 202 are provided to be adjacent to each other. In this case, since the antenna 201 is connected to the grounding conductor 102 via the grounding antenna element 112, a ground current flows in the grounding conductor 102 when the radio waves are received by the antenna 201 in accordance with the receiving. On the other hand, when the radio waves are received by the antenna 201, a ground current flows in the grounding conductor 102 in accordance with the receiving operation of the twenty-third and twenty-fourth radiating elements that are the monopole antennas among the twenty-third to twenty-fifth radiating elements. However, since the electrical length of the twenty-third radiating element is set to $(\alpha+\lambda_{23}/4)$, and the electrical length of the twenty-fourth radiating element is set to $(\beta+\lambda_{24}/4)$, the ground current is reduced further than when the twenty-third and twenty-fourth radiating elements have the electrical lengths $\lambda_{23}/4$ and $\lambda_{24}/4$, respectively. Therefore, the isolation between the antennas 201 and 202 can be obtained to be relatively large. Therefore, the gains of the antennas 201 and 202 can be prevented from substantially decreasing.

Moreover, since the antenna 201 has the coupling capacitance C, the phase of radiation waves excited at the receiving time of the antenna 201 shifts from the phases of radiation waves excited at the receiving time of the other antennas 201, 203 and 204. Therefore, the isolation between the antenna 201 and the other antennas 201, 203 and 204 can be obtained to be larger than that when the antenna 201 does not have the coupling capacitance C.

Further, the antennas 201 and 203 are provided to be adjacent to each other, the antenna 201 receives vertically polarized radio waves, while the antenna 203 receives horizontally polarized radio waves. Therefore, the direction of the ground current in accordance with the receiving operation of the antenna 201 and the direction of the ground current in accordance with the receiving operation of the antenna 203 are orthogonal to each other. Therefore, the isolation between the antennas 201 and 203 can be obtained to be relatively large. Therefore, the gains of the antennas 201 and 203 can be prevented from substantially decreasing.

Moreover, the antenna 201 receives vertically polarized radio waves, while the antenna 204 receives horizontally polarized radio waves. Therefore, the isolation between the antennas 201 and 204 can be obtained to be larger than that when the antennas 201 and 204 receive radio waves of identical polarization. Therefore, the gains of the antennas 201 and 204 can be prevented from substantially decreasing.

Moreover, according to the present embodiment, the antennas 201 to 204 can be provided in the vicinities of the grounding conductor 102, and therefore, the electronic device 100 can be further reduced in size than those of the prior art. Moreover, since the antenna casing for housing the antenna apparatus having the antennas 201 to 204 needs not be provided in the others than the main body casing of the electronic device 100, it is less expensive and superior in water resistance than those of the prior art.

Although the grounding conductor 102 is used as the grounding conductor for the antennas 201 to 204 in the present embodiment, the present disclosure is not limited to this. It is acceptable to use the grounding plate of the electronic device 100, such as the shield plate of the electronic device 100 as the grounding conductor for the antennas 201 and 203. Moreover, although the grounding conductor 102 has a rectangular shape in the present embodiment, the present disclosure is not limited to this, and the conductor may have an arbitrary shape.

Third Embodiment

Figure 22:
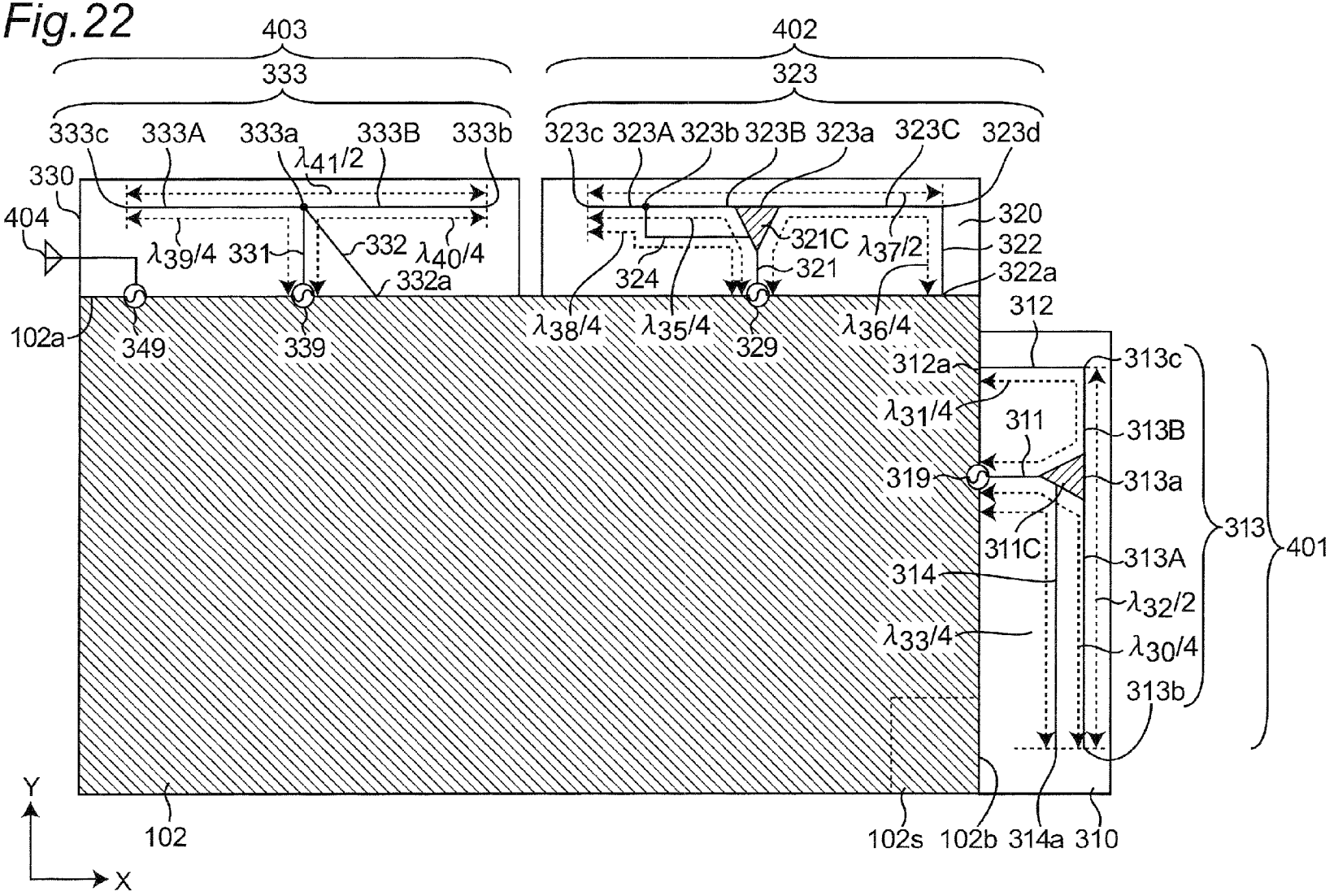
FIG. 22 is a plan view of an antenna apparatus according to a third embodiment of the present disclosure.

FIG. 22 is a plan view of an antenna apparatus according to the third embodiment of the present disclosure. The antenna apparatus of the present embodiment differs from the antenna apparatus of the first embodiment in that antennas 301, 302, 303 and 304 are provided in place of the antennas 1, 2, 3 and 4. Only the points of difference from the first embodiment are described below. It is noted that the rightward direction is referred to as an X-axis direction, and the upward direction is referred to as a Y-axis direction of FIG. 2. Further, a direction opposite to the X-axis direction is referred to as a −X-axis direction, and a direction opposite to the Y-axis direction is referred to as a −Y-axis direction.

Referring to FIG. 22, dielectric substrates 310, 320 and 330 are, for example, printed wiring boards, and are each fixed in an identical plane parallel to the surface of the grounding conductor 102. Moreover, an antenna 401 is provided at an edge portion 102*b*, an antenna 402 is provided in a right half region of the edge portion 102*a*, and an antenna 403 is provided in a left half region of the edge portion 102*a*. An antenna 4 is provided in an upper left corner portion of a grounding conductor 102. Further, a loudspeaker (not shown) is provided on the back side of a lower right edge portion 102*s* of the grounding conductor 102, and an operation panel (not shown) is provided on the left side of the grounding conductor 102.

Referring to FIG. 22, the antenna 404 is a monopole antenna, and is configured to include a radiating antenna element and a feeding point 349 provided at a left end portion of the edge portion 102*a*. The radiating antenna element extends in the −X-axis direction so as to protrude from the electronic device 100. The electrical length of the radiating antenna element is set to $\lambda_m/4$ that is a quarter of wavelength $\lambda_m$, and receives horizontally polarized radio waves having a predetermined frequency fm corresponding to the wavelength $\lambda_m$. When the radio waves are received by the antenna 404, a received signal received by the antenna 440 is outputted to a wireless communication circuit 104 via the feeding point 349 and a feeder cable.

Referring to FIG. 22, the antenna 401 is an inverted F antenna, and is configured to include the grounding conductor 102, a feeding antenna element 311, a grounding antenna element 312, radiating antenna elements 313 and 314, and a feeding point 319 provided at an edge portion 102*b*. In this case, the feeding antenna element 311, the grounding antenna element 312, and the radiating antenna elements 313 and 314 are each made of a conductive foil of copper, silver or the like formed on a dielectric substrate 310. It is noted that no grounding conductor is formed on the back surface of the dielectric substrate 310.

Referring to FIG. 22, the feeding antenna element 311 has one end connected to the feeding point 319, and another end that includes a diverging portion 311C connected to a predetermined connection point 313*a* of the radiating antenna element 313. The feeding antenna element 311 extends substantially in the X-axis direction from the feeding point 319 to the diverging portion 311C. In this case, the diverging portion 311C has a width set to expand from one end side of the feeding antenna element 311 toward the connection point 313*a*.

Moreover, referring to FIG. 22, the radiating antenna element 313 is configured to include element portions 313A and 313B that are connected to each other at the connection point 313*a*. Moreover, one end of the element portion 313A is connected to the connection point 313*a*, and another end of the element portion 313A is an open end 313*b*. The element portion 313A extends from the connection point 313*a* substantially in the −Y-axis direction along an edge portion of the dielectric substrate 310. Moreover, the element portion 313B extends from its one end connected to the connection point 313*a* to another end 313*c* connected to one end of the grounding antenna element 312 substantially in the Y-axis direction along an edge portion of the dielectric substrate 310. Further, referring to FIG. 22, the grounding antenna element 312 extends from its one end connected to another end 313*c* of the element portion 313B substantially in the −X-axis direction along an edge portion of the dielectric substrate 310, while another end 312*a* of the grounding antenna element 312 is grounded by being connected to the edge portion 102*b*.

Referring to FIG. 22, one end of the radiating antenna element 314 is connected to the diverging portion 311C, and another end of the radiating antenna element 314 is an open end 314*a*. The radiating antenna element 314 extends substantially in the −Y-axis direction from the diverging portion 311C. Moreover, the radiating antenna element 314 is formed to be substantially parallel to the element portion 313A so as to operate electromagnetically coupled to the element portion 313A.

As described above, the antenna 401 is configured to include the grounding antenna element 312 having one end 312*a* connected to the grounding conductor 102, the radiating antenna element 313 that is formed to be substantially parallel to the edge portion 102*a* of the grounding conductor 102 and has one end 313*c* connected to another end of the grounding antenna element 312, and the open end 313*b*, the feeding antenna element 311 configured to connect the feeding point 319 with the connection point 313*a* on the radiating antenna element 313, and the radiating antenna element 314. In this case, the radiating antenna element 314 has one end connected to the diverging portion 311C, and an open end 314*a*, and is formed to be electromagnetically coupled to the element portion 313A.

The antenna 401 configured as described above includes thirtieth to thirty-fourth radiating elements. In this case, as shown in FIG. 22, the thirtieth radiating element is a monopole antenna configured to include a radiating antenna element that includes a portion extending from the feeding point 319 to the open end 313*b* of the radiating antenna element 313 via the feeding antenna element 311, the connection point 313*a*, and the element portion 313A. The electrical length of the first radiating element is set to $\lambda_{30}/4$ that is a quarter of wavelength $\lambda_{30}$, and the thirtieth radiating element resonates at a resonance frequency f30 corresponding to the wavelength $\lambda_{30}$ and is able to receive a wireless signal having a radio frequency of the resonance frequency f30. Moreover, the thirty-first radiating element is a loop antenna configured to include a radiating antenna element that includes a portion extending from the feeding point 319 to another end 312*a* of the grounding antenna element 312 via the feeding antenna element 311, the connection point 313*a*, the element portion 313B, and the grounding antenna element 312. The electrical length of the thirty-first radiating element is set to $\lambda_{31}/4$ that is a quarter of wavelength $\lambda_{31}$, and the thirty-first radiating element resonates at a resonance frequency f31 corresponding to the wavelength $\lambda_{31}$ and is able to receive a wireless signal having a radio frequency of the resonance frequency f31.

Further, referring to FIG. 22, the thirty-second radiating element is a conductor-loaded monopole antenna configured to include a radiating antenna element that includes a portion extending from the open end 313*b* of the radiating antenna element 313 to another end 313*c* of the radiating antenna element 313 via the element portions 313A and 313B. The thirty-second radiating element is fed with electric power for excitation at the connection point 313*a* with the feeding antenna element 311 used as a feeding line. Moreover, the electrical length of the thirty-second radiating element is set to $\lambda_{32}/2$ that is a half of wavelength $\lambda_{32}$, and the thirty-second radiating element resonates at a resonance frequency f32 corresponding to the wavelength $\lambda_{32}$ and is able to receive a wireless signal having a radio frequency of the resonance frequency f32. Moreover, the thirty-third radiating element is a monopole antenna configured to include a radiating antenna element that includes a portion extending from the feeding point 319 to the open end 314*a* of the radiating antenna element 314 via the feeding antenna element 311, and the radiating antenna element 314. The electrical length of the thirty-third radiating element is set to $\lambda_{33}/4$ that is a quarter of wavelength $\lambda$33, and the thirty-third radiating element resonates at a resonance frequency f33 corresponding to the wavelength $\lambda_{33}$ and is able to receive a wireless signal having a radio frequency of the resonance frequency f33. It is noted that the wavelength $\lambda_{33}$ differs from the wavelength $\lambda_{30}$.

Further, referring to FIG. 22, the thirtieth radiating element and the thirty-third radiating element are electromagnetically coupled to each other and operates as a thirty-fourth radiating element. In this case, the thirty-fourth radiating element resonates at a resonance frequency f34 corresponding to a wavelength $\lambda_{34}$ and is able to receive a wireless signal of a radio frequency having a resonance frequency f34 between the resonance frequencies f30 and f33.

The antenna 401 configured as described above receives vertically polarized radio waves parallel to the X-axis direction. When the radio waves are received by the antenna 401, a received signal received by the antenna 401 is outputted to a wireless communication circuit 104 via the feeding point 319 and a feeder cable. Moreover, since the radiating antenna element 314 is provided, wireless signals having the resonance frequencies f33 and f34 can be received in addition to wireless signals having the resonance frequencies f30, f31 and f32, and a wider bandwidth is provided than that of the prior art inverted F antenna.

In general, when one band is handled by two radiating elements, if a difference between two radiative stopping resonance frequencies is comparatively large, there is such a possibility that a null point (antiresonance point) is generated in the band. In the case of the present embodiment, the thirtieth to thirty-fourth radiating elements are operated by diverging the path of a current flowing in the antenna 401 at the diverging portion 311C, and therefore, antiresonance occurs to generate a null point in the frequency characteristic of the gain of the antenna 401. According to the present embodiment, the diverging portion 311C is configured to have a width set to be expand from one end side of the feeding antenna element 311 toward the connection point 313*a*, and therefore, a wide band can be achieved. Further, it is possible to raise the frequency at the null point by reducing the inductance of the diverging portion 311C and move the point to the outside of the frequency band for the terrestrial digital television broadcasting.

Referring to FIG. 22, the antenna 402 is an inverted F antenna, and is configured to include the grounding conductor 102, a feeding antenna element 321, a grounding antenna element 322, radiating antenna elements 323 and 324, and a feeding point 329 provided at the edge portion 102*a*. In this case, the feeding antenna element 321, the grounding antenna element 322, and the radiating antenna elements 323 and 324 are each made of a conductive foil of copper, silver or the like formed on the dielectric substrate 320. It is noted that no grounding conductor is formed on the back surface of the dielectric substrate 320.

Referring to FIG. 22, one end of the feeding antenna element 321 is connected to the feeding point 329. The feeding antenna element 321 extends in the Y-axis direction from the feeding point 329, while another end of the feeding antenna element 321 is connected to a connection point 323*a* of the radiating antenna element 323. In this case, another end of the feeding antenna element 321 includes a diverging portion 321C. The diverging portion 321C has a width set to expand from its one end side connected to the feeding point 329 of the feeding antenna element 321 toward the connection point 323*a*. The radiating antenna element 324 extends in the −X-axis direction from the diverging portion 321C, thereafter extends in the Y-axis direction to an edge portion of the dielectric substrate 320, and is connected to a predetermined connection point 323*b* of the radiating antenna element 323.

Moreover, referring to FIG. 22, the radiating antenna element 323 is configured to include element portions 323A, 323B and 323C. In this case, the element portions 323A and 323B are connected to each other at the connection point 323*b*, and the element portions 323B and 323C are connected to each other at the connection point 323*a*. The element portion 323B is formed to be substantially parallel to the −X-axis direction along an edge portion of the dielectric substrate 320 from the connection point 323*a* to the connection point 323*b*.

Moreover, referring to FIG. 22, one end of the element portion 323A is connected to the connection point 323*b*, and another end of the element portion 323A is an open end 323*c*. Further, the element portion 323C extends from its one end connected to the connection point 323*a* to its other end

323*d* connected to one end of the grounding antenna element 322 substantially in the X-axis direction along an edge portion of the dielectric substrate 320. Further, referring to FIG. 22, the grounding antenna element 322 extends from its one end connected to another end 323*d* of the element portion 323C substantially in the −Y-axis direction along an edge portion of the dielectric substrate 320, while another end 322*a* of the grounding antenna element 322 is grounded by being connected to the edge portion 102*a*.

As described above, the antenna 402 is configured to include the grounding antenna element 322 having one end 322*a* connected to the grounding conductor 102, the radiating antenna element 323 that is formed to be substantially parallel to the edge portion 102*a* of the grounding conductor 102 and has one end 323*d* connected to another end of the grounding antenna element 322, the feeding antenna element 321 configured to connect the feeding point 329 with the connection point 323*a* on the radiating antenna element 323, and the radiating antenna element 324 configured to connect the connection point 321*a* on the feeding antenna element 321 with the connection point 323*b* on the radiating antenna element 323.

The antenna 402 configured as described above includes thirty-fifth to thirty-eighth radiating elements. In this case, as shown in FIG. 22, the thirty-fifth radiating element is a monopole antenna configured to include a radiating antenna element that includes a portion extending from the feeding point 329 to the open end 323*c* of the radiating antenna element 323 via the feeding antenna element 321, the element portion 323B, and the element portion 323A. The electrical length of the thirty-fifth radiating element is set to $\lambda_{35}/4$ that is a quarter of wavelength $\lambda_{35}$, and the thirty-fifth radiating element resonates at a resonance frequency f35 corresponding to the wavelength $\lambda_{35}$ and is able to receive a wireless signal having a radio frequency of the resonance frequency f35. Moreover, the thirty-sixth radiating element is a loop antenna configured to include a radiating antenna element that includes a portion extending from the feeding point 329 to another end 322*a* of the grounding antenna element 322 via the feeding antenna element 321, the element portion 323C, and the grounding antenna element 322. The electrical length of the thirty-sixth radiating element is set to $\lambda_{36}/4$ that is a quarter of wavelength $\lambda_{36}$, and the thirty-sixth radiating element resonates at a resonance frequency f36 corresponding to the wavelength $\lambda_{36}$ and is able to receive a wireless signal having a radio frequency of the resonance frequency f36.

Further, referring to FIG. 22, the thirty-seventh radiating element is a conductor-loaded monopole antenna configured to include a radiating antenna element that includes a portion extending from the open end 323*c* of the radiating antenna element 323 to another end 323*d* of the radiating antenna element 323 via the element portions 323A, 323B and 323C. The thirty-seventh radiating element is fed with electric power for excitation at the connection point 323*a* with the feeding antenna element 321 used as a feeding line. Moreover, the electrical length of the thirty-seventh radiating element is set to $\lambda_{37}/2$ that is a half of wavelength $\lambda_{37}$, and the thirty-seventh radiating element resonates at a resonance frequency f37 corresponding to the wavelength $\lambda_{37}$ and is able to receive a wireless signal having a radio frequency of the resonance frequency f37. Moreover, the thirty-eighth radiating element is a monopole antenna configured to include a radiating antenna element that includes a portion extending from the feeding point 329 to the open end 323*c* of the radiating antenna element 323 via the element portion 321A, the radiating antenna element 324, and the element portion 323A. The electrical length of the thirty-eighth radiating element is set to $\lambda_{38}/4$ that is a quarter of wavelength $\lambda_{38}$, and the thirty-eighth radiating element resonates at a resonance frequency f38 corresponding to the wavelength $\lambda_{38}$ and is able to receive a wireless signal having a radio frequency of the resonance frequency f38.

The antenna 402 configured as described above receives vertically polarized radio waves having a polarization direction parallel to the Y-axis direction. When the radio waves are received by the antenna 402, a received signal received by the antenna 402 is outputted to a wireless communication circuit 104 via the feeding point 329 and a feeder cable. Moreover, since the radiating antenna element 324 is provided, a wireless signal having the resonance frequency f38 can be received in addition to wireless signals having the resonance frequencies f35, f36 and f37, and a bandwidth wider than that of the prior art inverted F antenna is provided.

Moreover, since the thirty-fifth to thirty-eighth radiating elements are operated by diverging the path of the current flowing in the antenna 402 at the diverging portion 321C, antiresonance occurs to generate a null point in the frequency characteristic of the gain of the antenna 402. According to the present embodiment, the diverging portion 321C is configured to have a width set to expand from the one end side of the feeding antenna element 321 toward the connection point 323*a*, and therefore, a wider band can be achieved. Further, it is possible to raise the frequency at the null point by reducing the inductance of the diverging portion 321C and move the point to the outside of the frequency band for the terrestrial digital television broadcasting.

Referring to FIG. 22, the antenna 403 is a modified inverted F antenna, and is configured to include the grounding conductor 102, a feeding antenna element 331, an impedance adjusting element 332, a radiating antenna element 323, and a feeding point 339 provided at the edge portion 102*a*. In this case, the feeding antenna element 331, the impedance adjusting element 332 and the radiating antenna element 333 are each made of a conductive foil of copper, silver or the like formed on a dielectric substrate 330. It is noted that no grounding conductor is formed on the back surface of the dielectric substrate 330.

Referring to FIG. 22, one end of the feeding antenna element 331 is connected to the feeding point 339. The feeding antenna element 331 extends in the Y-axis direction to an edge portion of the dielectric substrate 330, and is thereafter connected to a predetermined connection point 333*a* of the radiating antenna element 333. Moreover, the impedance adjusting element 332 has one end connected to the connection point 333*a*, and another end 332*a* connected to the grounding conductor 102*a*. The impedance adjusting element 332 extends from the connection point 333*a* in a predetermined direction between the X-axis direction and the −Y-axis direction, and is thereafter connected to the grounding conductor 102*a*.

Moreover, referring to FIG. 22, the radiating antenna element 333 is configured to include element portions 333A and 333B that are connected to each other at the connection point 333*a*. The element portion 333A extends from its one end connected to the connection point 333*a* to its other end that is an open end 333*c* substantially in the −X-axis direction along an edge portion of the dielectric substrate 330. The element portion 333B extends from its one end connected to the connection point 333*a* to its other end that is an open end 333*b* substantially in the X-axis direction along an edge portion of the dielectric substrate 330.

The antenna 403 configured as described above includes thirty-ninth to forty-first radiating elements. In this case, as shown in FIG. 22, the thirty-ninth radiating element is a monopole antenna configured to include a radiating antenna element that includes a portion extending from the feeding point 339 to the open end 333*c* of the radiating antenna element 333 via the feeding antenna element 331, and the element portion 333A. The electrical length of the thirty-ninth radiating element is set to $\lambda_{39}/4$ that is a quarter of wavelength $\lambda_{39}$, and the thirty-ninth radiating element resonates at a resonance frequency f39 corresponding to the wavelength $\lambda_{39}$ and is able to receive a wireless signal having a radio frequency of the resonance frequency f39. Moreover, the fortieth radiating element is a monopole antenna configured to include a radiating antenna element that includes a portion extending from the feeding point 339 to the open end 333*b* of the radiating antenna element 333 via the feeding antenna element 331, and the element portion 333B. The electrical length of the fortieth radiating element is set to $\lambda_{40}/4$ that is a quarter of wavelength $\lambda_{40}$, and the fortieth radiating element resonates at a resonance frequency f40 corresponding to the wavelength $\lambda_{40}$ and is able to receive a wireless signal having a radio frequency of the resonance frequency f40.

Further, the forty-first radiating element is a conductor-loaded monopole antenna configured to include a radiating antenna element that includes a portion extending from the open end 333*c* of the radiating antenna element 333 to the open end 333*b* via the element portions 333A and 333B. The forty-first radiating element is fed with electric power for excitation at a connection point 433*a* with the feeding antenna element 431 used as a feeding line. Moreover, the electrical length of the forty-first radiating element is set to $\lambda_{41}/2$ that is a half of wavelength 241, and the forty-first radiating element resonates at a resonance frequency f41 corresponding to the wavelength $\lambda_{41}$ and is able to receive a wireless signal having a radio frequency of the resonance frequency f41.

The antenna 403 configured as described above receives vertically polarized radio waves having a polarization direction parallel to the Y-axis direction. When the radio waves are received by the antenna 403, a received signal received by the antenna 403 is outputted to the wireless communication circuit 104 via the feeding point 339 and a feeder cable. The impedance adjusting element 332, which is connected to the grounding conductor 102, does not contribute to the radiation of radio waves by the aforementioned thirty-ninth to forty-first radiating elements. Therefore, no ground current flows in the grounding conductor 102 when the radio waves are received by the antenna 403.

According to the present embodiment, the antennas 401 and 402 are provided to be adjacent to each other. In this case, the antenna 401 receives horizontally polarized radio waves while the antenna 402 receives vertically polarized radio waves. Therefore, the direction of a ground current in accordance with the receiving operation of the antenna 401 and the direction of a ground current in accordance with the receiving operation of the antenna 402 are orthogonal to each other. Therefore, the isolation between the antennas 401 and 402 can be obtained to be relatively large. Therefore, the gains of the antennas 401 and 402 can be prevented from substantially decreasing.

Moreover, although a ground current flows in the grounding conductor 102 when the radio waves are received by the antenna 402, no ground current flows in the grounding conductor 102 when the radio waves are received by the antenna 403. Therefore, the isolation between the antennas 402 and 403 can be obtained to be relatively large. Therefore, the gains of the antennas 402 and 403 can be prevented from substantially decreasing.

Further, the antenna 403 receives vertically polarized radio waves while the antenna 404 receives horizontally polarized radio waves. Therefore, the isolation between the antennas 403 and 404 can be obtained to be larger than that when the antennas 403 and 404 receive radio waves of an identical polarization. Therefore, the gains of the antennas 403 and 404 can be prevented from substantially decreasing.

Moreover, according to the present embodiment, since the antennas 401 to 404 can be provided in the vicinities of the grounding conductor 102 and the loudspeaker 102*s*, the electronic device 100 can be further reduced in size than those of the prior art. Moreover, since the antenna casing for housing the antenna apparatus including the antennas 401 to 404 needs not be provided in the others than the main body casing of the electronic device 100, it is less expensive and superior in water resistance than those of the prior art.

Although the grounding conductor 102 is used as the grounding conductor for the antennas 401 to 404 in the present embodiment, the present disclosure is not limited to this. It is acceptable to use the grounding plate of the electronic device, such as the shield plate of the electronic device as the grounding conductor for the antennas 401 to 404. Moreover, although the grounding conductor 102 has a rectangular shape in the present embodiment, the present disclosure is not limited to this, and the conductor may have an arbitrary shape.

Other Embodiments

The aforementioned embodiments have been described as illustrations of the technology disclosed in the present application. However, the technology in the present disclosure is not limited to this but applicable also to embodiments that are arbitrarily subjected to modifications, replacements, additions and omissions. Moreover, it is also possible to provide new embodiments by combining the constituent elements described in the aforementioned embodiments. Accordingly, other embodiments are illustrated below.

Although the dielectric substrates 10, 20, 30, 40, 110, 120, 130, 310, 320 and 330 are each fixed to an identical plane parallel to the grounding conductor 102 in the aforementioned embodiments and modified embodiment, the present disclosure is not limited to this, and it is acceptable to fix the dielectric substrates in mutually different planes parallel to the grounding conductor 102.

Moreover, although the antenna apparatus having the four antennas wirelessly receives the radio waves in the frequency band for the terrestrial digital television broadcasting in each of the aforementioned embodiments and modified embodiment, the present disclosure is not limited to this, and a wireless signal from the wireless communication circuit 104 may be wirelessly transmitted.

Furthermore, although the present disclosure has been described by taking the electronic device 100 that is a portable type television broadcasting receiver apparatus for receiving the radio waves in the frequency band for the terrestrial digital television broadcasting as an example in each of the aforementioned embodiments and modification, the present disclosure is not limited to this but applicable to a wireless communication apparatus 105 including the aforementioned antenna apparatus and a wireless communication circuit 104 for transmitting and receiving wireless signals by using the antenna apparatus.

Moreover, the present disclosure is applicable to electronic device such as a portable telephone including the aforementioned wireless communication apparatus and a display apparatus for displaying the video signal included in the wireless signals received by the wireless communication apparatus.

Moreover, the antennas 1 to 4, 1A to 4A, 201, 203, 401 and 402 are inverted F antennas in the aforementioned embodiments and modification, the present disclosure is not limited to this.

Moreover, the antenna configuration of the second embodiment may be applied to the antenna of the first embodiment.

As described above, the embodiments have been described as illustrations of the technology in the present disclosure. For the above purposes, the accompanying drawings and the detailed description are provided.

Therefore, the constituent elements described in the accompanying drawings and the detailed description may include not only indispensable constituent elements for solving the problems but also constituent elements that are not indispensable for solving the problems in order to illustrate the aforementioned technology. Therefore, it should not be immediately certified that those constituent elements, which are not indispensable, are indispensable by the fact that those constituent elements, which are not indispensable, are described in the accompanying drawings and the detailed description.

Moreover, the aforementioned embodiments are for illustrating the technology in the present disclosure, and therefore, various modifications, replacements, additions, omissions and the like can be performed within the scope of the claims and a scope equivalent to them.

As described above, the antenna apparatus, the wireless communication apparatus and the electronic device of the present disclosure are applicable to a portable type television broadcasting receiver apparatus for receiving the radio waves in the frequency band for the terrestrial digital television broadcasting. Moreover, it is applicable to a wireless communication apparatus including a wireless communication circuit for transmitting and receiving wireless signals by using the antenna apparatus, and an electronic device such as a portable telephone including the wireless communication apparatus, and the display apparatus to display the video signal included in the wireless signals received by the wireless communication apparatus.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An antenna apparatus consisting essentially of:

a first antenna on a first dielectric substrate and configured to include:

a first radiating antenna element that includes a first linear portion, a second linear portion, and an open end, is formed to be substantially parallel to a predetermined first direction, and is fed with electric power from a first feeding point provided at a first edge portion of a grounding conductor;

a first feeding antenna element; and a first grounding antenna element;

a second antenna on a second dielectric substrate and configured to include:

a second radiating antenna element that includes a third linear portion, a fourth linear portion, and an open end, is formed to be substantially parallel to a predetermined second direction different from the predetermined first direction, and is fed with electric power from a second feeding point provided at a second edge portion of the grounding conductor;

a second feeding antenna element; and a second grounding antenna element;

a third antenna on a third dielectric substrate and configured to include:

a third radiating antenna element that includes a fifth linear portion, a sixth linear portion, and an open end, is formed to be substantially parallel to the predetermined second direction, and is fed with electric power from a third feeding point provided at the second edge portion of the grounding conductor;

a third feeding antenna element; and a third grounding antenna element; and a fourth antenna on a fourth dielectric substrate and configured to include:

a fourth radiating antenna element that includes a seventh linear portion, an eighth linear portion, and an open end, is formed to be substantially parallel to the predetermined first direction, and is fed with electric power from a fourth feeding point provided at a third edge portion of the grounding conductor;

a fourth feeding antenna element; and a fourth grounding antenna element, wherein the second linear portion extends from the open end of the first radiating antenna element, and each of the first grounding antenna element, the first feeding antenna element, and the second linear portion are spaced from and parallel to each other, and perpendicular to the first linear portion, wherein the fourth linear portion extends from the open end of the second radiating antenna element, and each of the second grounding antenna element, the second feeding antenna element, and the fourth linear portion are spaced from and parallel to each other, and perpendicular to the third linear portion, wherein the sixth linear portion extends from the open end of the third radiating antenna element, and each of the third grounding antenna element, the third feeding antenna element, and the sixth linear portion are spaced from and parallel to each other, and perpendicular to the fifth linear portion, wherein the eighth linear portion extends from the open end of the fourth radiating antenna element, and each of the fourth grounding antenna element, the fourth feeding antenna element, and the eighth linear portion are spaced from and parallel to each other, and perpendicular to the seventh linear portion, wherein the first dielectric substrate is parallel to the first edge portion, wherein the second dielectric substrate is parallel to the second edge portion, wherein the third dielectric substrate is parallel to the second edge portion, wherein the fourth dielectric substrate is parallel to the third edge portion, wherein the first and fourth antennas are provided to be symmetrical with respect to a predetermined symmetry line on the grounding conductor, wherein the second and third antennas are arranged to be symmetrical with respect to the predetermined symmetry line so that the second and third feeding points are separated apart by a predetermined distance, and wherein the first to fourth antennas each have a planar shape, and lie in planes parallel to a plane of the grounding conductor.

2. The antenna apparatus as claimed in claim 1, wherein the first antenna further comprises:

the first grounding antenna element having one end connected to the grounding conductor and another end connected to one end of the first radiating antenna element; and the first feeding antenna element configured to connect the first feeding point with a predetermined first connection point on the first radiating antenna element, wherein another end of the first radiating antenna element is the open end of the first radiating antenna element, whereby the first antenna is a first inverted F antenna, wherein the second antenna further comprises:

the second grounding antenna element having one end connected to the grounding conductor and another end connected to one end of the second radiating antenna element; and the second feeding antenna element configured to connect the second feeding point with a predetermined second connection point on the second radiating antenna element, wherein another end of the second radiating antenna element is the open end of the second radiating antenna element, whereby the second antenna is a second inverted F antenna, wherein the third antenna further comprises:

the third grounding antenna element having one end connected to the grounding conductor and another end connected to one end of the third radiating antenna element; and the third feeding antenna element configured to connect the third feeding point with a predetermined third connection point on the third radiating antenna element, wherein another end of the third radiating antenna element is the open end of the third radiating antenna element, whereby the third antenna is a third inverted F antenna, wherein the fourth antenna further comprises:

the fourth grounding antenna element having one end connected to the grounding conductor and another end connected to one end of the fourth radiating antenna element; and the fourth feeding antenna element configured to connect the fourth feeding point with a predetermined fourth connection point on the fourth radiating antenna element, and wherein another end of the fourth radiating antenna element is the open end of the fourth radiating antenna element, whereby the fourth antenna is a fourth inverted F antenna.

3. The antenna apparatus as claimed in claim 2, wherein the first antenna further comprises:

a first radiating element configured to include a portion extending from the first feeding point to the open end of the first radiating antenna element via the first feeding antenna element, the first connection point, and an element portion from the first connection point of the first radiating antenna element to the open end of the first radiating antenna element, the first radiating element resonating at a first wavelength;

a second radiating element configured to include a portion extending from the first feeding point to the one end of the first grounding antenna element via the first feeding antenna element, the first connection point, and an element portion from the first connection point of the first radiating antenna element to the one end of the first radiating antenna element, the second radiating element resonating at a second wavelength; and a third radiating element configured to include a portion extending from the one end to the open end of the first radiating antenna element, the third radiating element resonating at a third wavelength.

4. The antenna apparatus as claimed in claim 2, wherein the second antenna further comprises:

a fourth radiating element configured to include a portion extending from the second feeding point to the open end of the second radiating antenna element via the second feeding antenna element, the second connection point, and an element portion from the second connection point of the second radiating antenna element to the open end of the second radiating antenna element, the fourth radiating element resonating at a fourth wavelength;

a fifth radiating element configured to include a portion extending from the second feeding point to one end of the second grounding antenna element via the second feeding antenna element, the second connection point, and an element portion from the second connection point of the second radiating antenna element to the one end of the second radiating antenna element, the fifth radiating element resonating at a fifth wavelength; and a sixth radiating element configured to include a portion extending from the one end to the open end of the second radiating antenna element, the sixth radiating element resonating at a sixth wavelength.

5. The antenna apparatus as claimed in claim 2, wherein the third antenna further comprises:

a seventh radiating element configured to include a portion extending from the third feeding point to the open end of the third radiating antenna element via the third feeding antenna element, the third connection point, and an element portion extending from the third connection point of the third radiating antenna element to the open end of the third radiating antenna element, the seventh radiating element resonating at a seventh wavelength;

an eighth radiating element configured to include a portion extending from the third feeding point to the one end of the third grounding antenna element via the third feeding antenna element, the third connection point, and an element portion extending from the third connection point of the third radiating antenna element to the one end of the third radiating antenna element, the eighth radiating element resonating at an eighth wavelength; and a ninth radiating element configured to include a portion extending from the one end to the open end of the third radiating antenna element, the ninth radiating element resonating at a ninth wavelength.

6. The antenna apparatus as claimed in claim 2, wherein the fourth antenna further comprises:

a tenth radiating element configured to include a portion extending from the fourth feeding point to the open end of the fourth radiating antenna element via the fourth feeding antenna element, the fourth connection point, and an element portion extending from the fourth connection point of the fourth radiating antenna element to the open end of the fourth radiating antenna element, the tenth radiating element resonating at a tenth wavelength;

an eleventh radiating element configured to include a portion extending from the fourth feeding point to the one end of the fourth grounding antenna element via the fourth feeding antenna element, the fourth connection point, and an element portion extending from the fourth connection point of the fourth radiating antenna element to the one end of the fourth radiating antenna element, the eleventh radiating element resonating at an eleventh wavelength; and a twelfth radiating element configured to include a portion extending from the one end to the open end of the fourth radiating antenna element, the twelfth radiating element resonating at a twelfth wavelength.

7. The antenna apparatus as claimed in claim 1, wherein the predetermined first direction is substantially perpendicular to the predetermined second direction.

8. The antenna apparatus as claimed in claim 1, wherein the antenna apparatus is provided for use in an electronic device having a grounding plate, and wherein the grounding conductor is the grounding plate.

9. The antenna apparatus as claimed in claim 8, wherein the predetermined symmetry line divides the grounding plate into two parts, and passes through a weight center of the grounding plate.

10. A wireless communication apparatus comprising:

an antenna apparatus; and a wireless communication circuit configured to transmit and receive a wireless signal by using the antenna apparatus, wherein the antenna apparatus consists essentially of:

a first antenna on a first dielectric substrate and having:

a first radiating antenna element that includes a first linear portion, a second linear portion, and an open end, is formed to be substantially parallel to a predetermined first direction, and is fed with electric power from a first feeding point provided at a first edge portion of a grounding conductor;

a first feeding antenna element; and a first grounding antenna element;

a second antenna on a second dielectric substrate and having:

a second radiating antenna element that includes a third linear portion, a fourth linear portion, and an open end, is formed to be substantially parallel to a predetermined second direction different from the predetermined first direction, and is fed with electric power from a second feeding point provided at a second edge portion of the grounding conductor;

a second feeding antenna element; and a second grounding antenna element;

a third antenna on a third dielectric substrate and having:

a third radiating antenna element that includes a fifth linear portion, a sixth linear portion, and an open end, is formed to be substantially parallel to the predetermined second direction, and is fed with electric power from a third feeding point provided at the second edge portion of the grounding conductor;

a third feeding antenna element; and a third grounding antenna element; and a fourth antenna on a fourth dielectric substrate and having:

a fourth radiating antenna element that includes a seventh linear portion, an eighth linear portion, and an open end, is formed to be substantially parallel to the predetermined first direction, and is fed with electric power from a fourth feeding point provided at a third edge portion of the grounding conductor;

a fourth feeding antenna element; and a fourth grounding antenna element, wherein the second linear portion extends from the open end of the first radiating antenna element, and each of the first grounding antenna element, the first feeding antenna element, and the second linear portion are spaced from and parallel to each other, and perpendicular to the first linear portion, wherein the fourth linear portion extends from the open end of the second radiating antenna element, and each of the second grounding antenna element, the second feeding antenna element, and the fourth linear portion are spaced from and parallel to each other, and perpendicular to the third linear portion, wherein the sixth linear portion extends from the open end of the third radiating antenna element, and each of the third grounding antenna element, the third feeding antenna element, and the sixth linear portion are spaced from and parallel to each other, and perpendicular to the fifth linear portion, wherein the eighth linear portion extends from the open end of the fourth radiating antenna element, and each of the fourth grounding antenna element, the fourth feeding antenna element, and the eighth linear portion are spaced from and parallel to each other, and perpendicular to the seventh linear portion, wherein the first dielectric substrate is parallel to the first edge portion, wherein the second dielectric substrate is parallel to the second edge portion, wherein the third dielectric substrate is parallel to the second edge portion, wherein the fourth dielectric substrate is parallel to the third edge portion, wherein the first and fourth antennas are provided to be symmetrical with respect to a predetermined symmetry line on the grounding conductor, wherein the second and third antennas are arranged to be symmetrical with respect to the predetermined symmetry line so that the second and third feeding points are separated apart by a predetermined distance, and wherein the first to fourth antennas each have a planar shape, and lie in planes parallel to a plane of the grounding conductor.

11. An electronic device comprising:

a wireless communication apparatus; and a display apparatus configured to display a video signal included in a wireless signal, wherein the wireless communication apparatus comprises:

an antenna apparatus; and a wireless communication circuit configured to transmit and receive the wireless signal by using the antenna apparatus, wherein the antenna apparatus consists essentially of:

a first antenna on a first dielectric substrate and having:

a first radiating antenna element that includes a first linear portion, a second linear portion, and an open end, is formed to be substantially parallel to a predetermined first direction, and is fed with electric power from a first feeding point provided at a first edge portion of a grounding conductor;

a first feeding antenna element; and a first grounding antenna element;

a second antenna on a second dielectric substrate and having:

a second radiating antenna element that includes a third linear portion, a fourth linear portion, and an open end, is formed to be substantially parallel to a predetermined second direction different from the predetermined first direction, and is fed with electric power from a second feeding point provided at a second edge portion of the grounding conductor;

a second feeding antenna element; and a second grounding antenna element;

a third antenna on a third dielectric substrate and having:

a third radiating antenna element that includes a fifth linear portion, a sixth linear portion, and an open end, is formed to be substantially parallel to the predetermined second direction, and is fed with electric power from a third feeding point provided at the second edge portion of the grounding conductor;

a third feeding antenna element; and a third grounding antenna element; and a fourth antenna on a fourth dielectric substrate and having:

a fourth radiating antenna element that includes a seventh linear portion, an eighth linear portion, and an open end, is formed to be substantially parallel to the predetermined first direction, and is fed with electric power from a fourth feeding point provided at a third edge portion of the grounding conductor;

a fourth feeding antenna element; and a fourth grounding antenna element, wherein the second linear portion extends from the open end of the first radiating antenna element, and each of the first grounding antenna element, the first feeding antenna element, and the second linear portion are spaced from and parallel to each other, and perpendicular to the first linear portion, wherein the fourth linear portion extends from the open end of the second radiating antenna element, and each of the second grounding antenna element, the second feeding antenna element, and the fourth linear portion are spaced from and parallel to each other, and perpendicular to the third linear portion, wherein the sixth linear portion extends from the open end of the third radiating antenna element, and each of the third grounding antenna element, the third feeding antenna element, and the sixth linear portion are spaced from and parallel to each other, and perpendicular to the fifth linear portion, wherein the eighth linear portion extends from the open end of the fourth radiating antenna element, and each of the fourth grounding antenna element, the fourth feeding antenna element, and the eighth linear portion are spaced from and parallel to each other, and perpendicular to the seventh linear portion, wherein the first dielectric substrate is parallel to the first edge portion, wherein the second dielectric substrate is parallel to the second edge portion, wherein the third dielectric substrate is parallel to the second edge portion, wherein the fourth dielectric substrate is parallel to the third edge portion, wherein the first and fourth antennas are provided to be symmetrical with respect to a predetermined symmetry line on the grounding conductor, wherein the second and third antennas are arranged to be symmetrical with respect to the predetermined symmetry line so that the second and third feeding points are separated apart by a predetermined distance, and wherein the first to fourth antennas each have a planar shape, and lie in planes parallel to a plane of the grounding conductor.

12. The wireless communication apparatus as claimed in claim 10, wherein the first antenna further comprises:

the first grounding antenna element having one end connected to the grounding conductor and another end connected to one end of the first radiating antenna element; and the first feeding antenna element configured to connect the first feeding point with a predetermined first connection point on the first radiating antenna element, wherein another end of the first radiating antenna element is the open end of the first radiating antenna element, whereby the first antenna is a first inverted F antenna, wherein the second antenna further comprises:

the second grounding antenna element having one end connected to the grounding conductor and another end connected to one end of the second radiating antenna element; and the second feeding antenna element configured to connect the second feeding point with a predetermined second connection point on the second radiating antenna element, wherein another end of the second radiating antenna element is the open end of the second radiating antenna element, whereby the second antenna is a second inverted F antenna, wherein the third antenna further comprises:

the third grounding antenna element having one end connected to the grounding conductor and another end connected to one end of the third radiating antenna element; and the third feeding antenna element configured to connect the third feeding point with a predetermined third connection point on the third radiating antenna element, wherein another end of the third radiating antenna element is the open end of the third radiating antenna element, whereby the third antenna is a third inverted F antenna, wherein the fourth antenna further comprises:

the fourth grounding antenna element having one end connected to the grounding conductor and another end connected to one end of the fourth radiating antenna element; and the fourth feeding antenna element configured to connect the fourth feeding point with a predetermined fourth connection point on the fourth radiating antenna element, and wherein another end of the fourth radiating antenna element is the open end of the fourth radiating antenna element, whereby the fourth antenna is a fourth inverted F antenna.

13. The electronic device as claimed in claim 11, wherein the first antenna further comprises:

the first grounding antenna element having one end connected to the grounding conductor and another end connected to one end of the first radiating antenna element; and the first feeding antenna element configured to connect the first feeding point with a predetermined first connection point on the first radiating antenna element, wherein another end of the first radiating antenna element is the open end of the first radiating antenna element, whereby the first antenna is a first inverted F antenna, wherein the second antenna further comprises:

the second grounding antenna element having one end connected to the grounding conductor and another end connected to one end of the second radiating antenna element; and the second feeding antenna element configured to connect the second feeding point with a predetermined second connection point on the second radiating antenna element, wherein another end of the second radiating antenna element is the open end of the second radiating antenna element, whereby the second antenna is a second inverted F antenna, wherein the third antenna further comprises:

the third grounding antenna element having one end connected to the grounding conductor and another end connected to one end of the third radiating antenna element; and the third feeding antenna element configured to connect the third feeding point with a predetermined third connection point on the third radiating antenna element, wherein another end of the third radiating antenna element is the open end of the third radiating antenna element, whereby the third antenna is a third inverted F antenna, wherein the fourth antenna further comprises:

the fourth grounding antenna element having one end connected to the grounding conductor and another end connected to one end of the fourth radiating antenna element; and the fourth feeding antenna element configured to connect the fourth feeding point with a predetermined fourth connection point on the fourth radiating antenna element, and wherein another end of the fourth radiating antenna element is the open end of the fourth radiating antenna element, whereby the fourth antenna is a fourth inverted F antenna.

14. The antenna apparatus as claimed in claim 2, wherein the one end of the first grounding antenna element which is connected to the ground conductor is formed to be closer to the grounded one end of the second grounding antenna element than the second feeding point of the second feeding antenna element, wherein the one end of the second grounding antenna element which is connected to the ground conductor is formed to be closer to the grounded one end of the first grounding antenna element than the first feeding point of the first feeding antenna element, wherein the one end of the third grounding antenna element which is connected to the ground conductor is formed to be closer to the grounded one end of the fourth grounding antenna element than the fourth feeding point of the fourth feeding antenna element, and wherein the one end of the fourth grounding antenna element which is connected to the ground conductor is formed to be closer to the grounded one end of the third grounding antenna element than the third feeding point of the third feeding antenna element.

15. The wireless communication apparatus as claimed in claim 12, wherein the one end of the first grounding antenna element which is connected to the ground conductor is formed to be closer to the grounded one end of the second grounding antenna element than the second feeding point of the second feeding antenna element, wherein the one end of the second grounding antenna element which is connected to the ground conductor is formed to be closer to the grounded one end of the first grounding antenna element than the first feeding point of the first feeding antenna element, wherein the one end of the third grounding antenna element which is connected to the ground conductor is formed to be closer to the grounded one end of the fourth grounding antenna element than the fourth feeding point of the fourth feeding antenna element, and wherein the one end of the fourth grounding antenna element which is connected to the ground conductor is formed to be closer to the grounded one end of the third grounding antenna element than the third feeding point of the third feeding antenna element.

16. The electronic device as claimed in claim 13, wherein the one end of the first grounding antenna element which is connected to the ground conductor is formed to be closer to the grounded one end of the second grounding antenna element than the second feeding point of the second feeding antenna element, wherein the one end of the second grounding antenna element which is connected to the ground conductor is formed to be closer to the grounded one end of the first grounding antenna element than the first feeding point of the first feeding antenna element, wherein the one end of the third grounding antenna element which is connected to the ground conductor is formed to be closer to the grounded one end of the fourth grounding antenna element than the fourth feeding point of the fourth feeding antenna element, and wherein the one end of the fourth grounding antenna element which is connected to the ground conductor is formed to be closer to the grounded one end of the third grounding antenna element than the third feeding point of the third feeding antenna element.

17. The antenna apparatus as claimed in claim 1, wherein the first radiating antenna element includes at least a first portion and a second portion, the first portion of the first radiating antenna element having an electrical length set to one of a quarter wavelength and a half wavelength of a first wavelength, and the second portion of the first radiating element antenna having an electrical length set to the other of the quarter wavelength and the half wavelength of the first wavelength, wherein the second radiating antenna element includes at least a first portion and a second portion, the first portion of the second radiating antenna element having an electrical length set to one of a quarter wavelength and a half wavelength of a second wavelength, and the second portion of the second radiating element antenna having an electrical length set to the other of the quarter wavelength and the half wavelength of the second wavelength, wherein the third radiating antenna element includes at least a first portion and a second portion, the first portion of the third radiating antenna element having an electrical length set to one of a quarter wavelength and a half wavelength of a third wavelength, and the second portion of the third radiating element antenna having an electrical length set to the other of the quarter wavelength and the half wavelength of the third wavelength, wherein the fourth radiating antenna element includes at least a first portion and a second portion, the first portion of the fourth radiating antenna element having an electrical length set to one of a quarter wavelength and a half wavelength of a fourth wavelength, and the second portion of the fourth radiating element antenna having an electrical length set to the other of the quarter wavelength and the half wavelength of the fourth wavelength, wherein the first and fourth antennas are provided to be mirror symmetrical with respect to the predetermined symmetry line on the grounding conductor, and wherein the second and third antennas are arranged to be mirror symmetrical with respect to the predetermined symmetry line on the grounding conductor.

18. The wireless communication apparatus as claimed in claim 10, wherein the first radiating antenna element includes at least a first portion and a second portion, the first portion of the first radiating antenna element having an electrical length set to one of a quarter wavelength and a half wavelength of a first wavelength, and the second portion of the first radiating element antenna having an electrical length set to the other of the quarter wavelength and the half wavelength of the first wavelength, wherein the second radiating antenna element includes at least a first portion and a second portion, the first portion of the second radiating antenna element having an electrical length set to one of a quarter wavelength and a half wavelength of a second wavelength, and the second portion of the second radiating element antenna having an electrical length set to the other of the quarter wavelength and the half wavelength of the second wavelength, wherein the third radiating antenna element includes at least a first portion and a second portion, the first portion of the third radiating antenna element having an electrical length set to one of a quarter wavelength and a half wavelength of a third wavelength, and the second portion of the third radiating element antenna having an electrical length set to the other of the quarter wavelength and the half wavelength of the third wavelength, wherein the fourth radiating antenna element includes at least a first portion and a second portion, the first portion of the fourth radiating antenna element having an electrical length set to one of a quarter wavelength and a half wavelength of a fourth wavelength, and the second portion of the fourth radiating element antenna having an electrical length set to the other of the quarter wavelength and the half wavelength of the fourth wavelength, wherein the first and fourth antennas are provided to be mirror symmetrical with respect to the predetermined symmetry line on the grounding conductor, and wherein the second and third antennas are arranged to be mirror symmetrical with respect to the predetermined symmetry line on the grounding conductor.

19. The electronic device as claimed in claim 11, wherein the first radiating antenna element includes at least a first portion and a second portion, the first portion of the first radiating antenna element having an electrical length set to one of a quarter wavelength and a half wavelength of a first wavelength, and the second portion of the first radiating element antenna having an electrical length set to the other of the quarter wavelength and the half wavelength of the first wavelength, wherein the second radiating antenna element includes at least a first portion and a second portion, the first portion of the second radiating antenna element having an electrical length set to one of a quarter wavelength and a half wavelength of a second wavelength, and the second portion of the second radiating element antenna having an electrical length set to the other of the quarter wavelength and the half wavelength of the second wavelength, wherein the third radiating antenna element includes at least a first portion and a second portion, the first portion of the third radiating antenna element having an electrical length set to one of a quarter wavelength and a half wavelength of a third wavelength, and the second portion of the third radiating element antenna having an electrical length set to the other of the quarter wavelength and the half wavelength of the third wavelength, wherein the fourth radiating antenna element includes at least a first portion and a second portion, the first portion of the fourth radiating antenna element having an electrical length set to one of a quarter wavelength and a half wavelength of a fourth wavelength, and the second portion of the fourth radiating element antenna having an electrical length set to the other of the quarter wavelength and the half wavelength of the fourth wavelength, wherein the first and fourth antennas are provided to be mirror symmetrical with respect to the predetermined symmetry line on the grounding conductor, and wherein the second and third antennas are arranged to be mirror symmetrical with respect to the predetermined symmetry line on the grounding conductor.

* * * * *